United States Patent [19]

Yoshida et al.

[11] Patent Number: 4,691,788

[45] Date of Patent: Sep. 8, 1987

[54] LATERAL HOLE BORING METHOD AND APPARATUS

[75] Inventors: Shoji Yoshida, Funabashi; Yasuhiko Haru; Etsuji Kosaka, both of Yokohama; Toshimichi Ikeda, Ibaraki; Mikio Aoyama, Matsudo; Takeo Iida, Tokyo, all of Japan

[73] Assignees: Hitachi Construction Machinery Co., Ltd.; Tokyo Gas Co., Ltd., both of Tokyo, Japan

[21] Appl. No.: 751,735

[22] Filed: Jul. 3, 1985

[30] Foreign Application Priority Data

| | | | |
|---|---|---|---|
| Jul. 4, 1984 | [JP] | Japan | 59-137094 |
| Jul. 4, 1984 | [JP] | Japan | 59-137095 |
| Jul. 4, 1984 | [JP] | Japan | 59-137096 |
| Jul. 4, 1984 | [JP] | Japan | 59-137097 |
| Jul. 4, 1984 | [JP] | Japan | 59-100010[U] |

[51] Int. Cl.[4] ..... E21B 7/00

[52] U.S. Cl. ..... 175/62; 175/78; 175/202; 175/203; 175/220

[58] Field of Search ..... 175/62, 78, 171, 220, 175/202, 203, 122; 173/35

[56] References Cited

U.S. PATENT DOCUMENTS

| | | | |
|---|---|---|---|
| 1,362,775 | 12/1920 | Bunker | 175/104 |
| 1,593,629 | 7/1926 | Hansen | 173/35 |
| 1,932,068 | 10/1933 | Englebright et al. | 175/62 |
| 2,165,666 | 7/1939 | Tilly | 175/62 |
| 2,588,068 | 3/1952 | Williams et al. | 175/78 |
| 2,752,122 | 6/1956 | Hyatt et al. | 175/122 |
| 2,889,137 | 6/1959 | Walker | 175/78 |
| 3,282,356 | 11/1966 | Paulson et al. | 175/220 |
| 4,222,687 | 9/1980 | Williams | 408/79 |
| 4,226,288 | 10/1980 | Collins, Jr. | 175/62 |
| 4,317,492 | 3/1982 | Summers et al. | 175/79 |
| 4,365,676 | 12/1982 | Boyadjieff et al. | 175/61 |
| 4,417,628 | 11/1983 | Gessner | 173/29 |
| 4,542,796 | 9/1985 | Delbare | 175/62 |

FOREIGN PATENT DOCUMENTS

| | | |
|---|---|---|
| 85108240 | 1/1985 | European Pat. Off. . |
| 448111 | 8/1927 | Fed. Rep. of Germany . |
| 3139655 | 4/1983 | Fed. Rep. of Germany . |
| 153931 | 12/1920 | United Kingdom . |

OTHER PUBLICATIONS

Burying Wire and Cable Under Obstructions–D. Milsark, Bell Laboratories Record, pp. 70–74, vol. 45, No. 3, 3/1967.

*Primary Examiner*—James A. Leppink
*Assistant Examiner*—Hoang C. Dang
*Attorney, Agent, or Firm*—Antonelli, Terry & Wands

[57] ABSTRACT

A lateral hole boring method whereby a lateral hole of a desired length is formed underground by repeatedly performing the following steps. A vertical hole is prepared, and a lateral hole boring apparatus equipped with a leading auger of a smaller length than the diameter of the vertical hole is lowered into the vertical hole to a predetermined position. The apparatus is manipulated from the ground level to advance and rotate the leading auger to bore a lateral hole. When the lateral hole has reached a predetermined length commensurate with the length of the leading auger, the advance movement of the leading auger is stopped, and the lateral hole boring apparatus is manipulated from the ground level to detach the leading auger therefrom, and is lifted above the vertical hole while leaving the leading auger in the lateral hole. A coupling auger of a smaller length than the diameter of the vertical hole is attached to the lateral hole boring apparatus outside the vertical hole, and the apparatus is lowered into the vertical hole again. Then, the lateral hole boring apparatus is manipulated from the ground level to couple the coupling auger to the leading auger left behind in the lateral hole.

17 Claims, 44 Drawing Figures

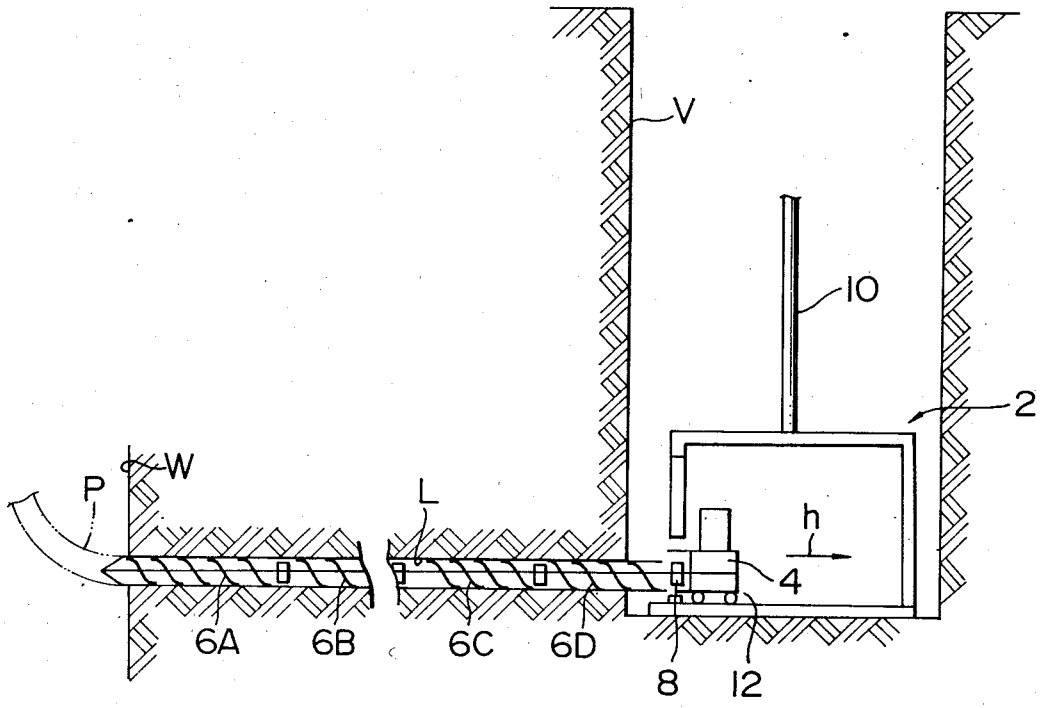
FIG. IE

FIG. IF
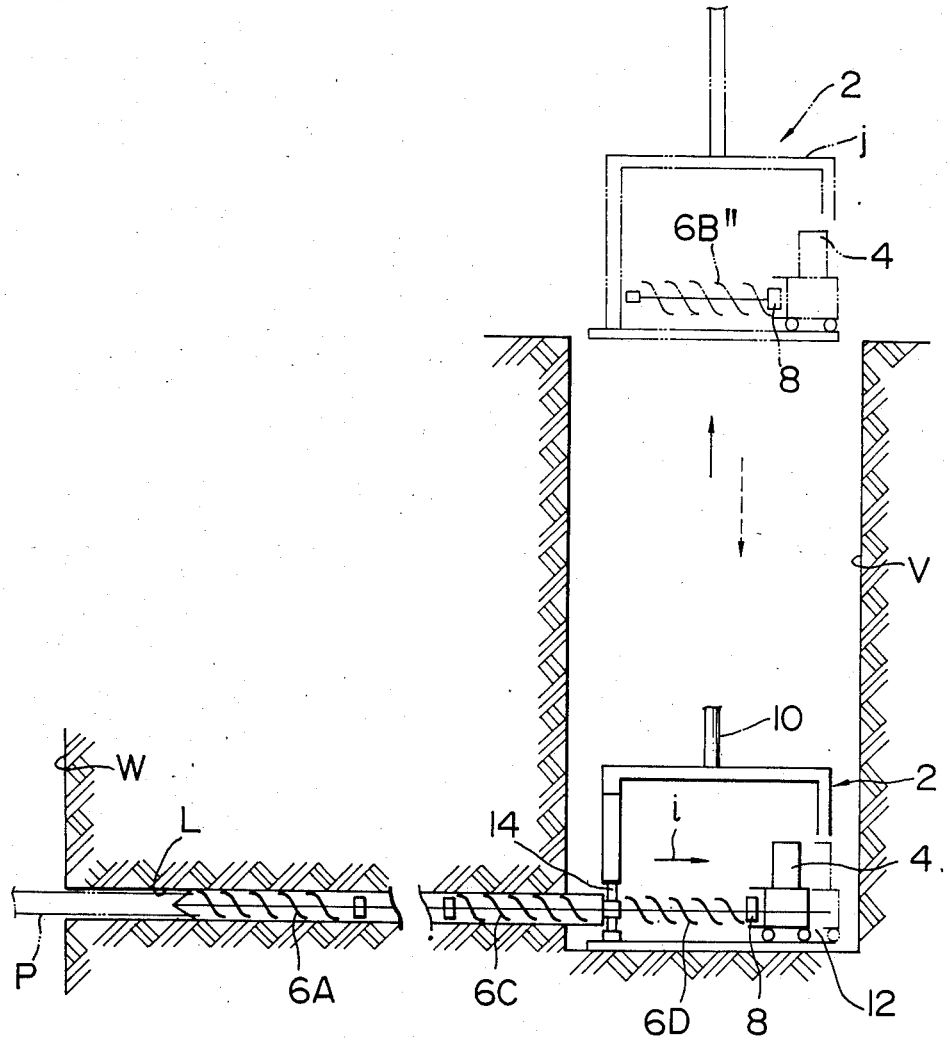

LATERAL HOLE BORING METHOD AND APPARATUS

BACKGROUND OF THE INVENTION

This invention relates to a method and apparatus for boring an underground lateral hole of relatively small diameter, such as a lateral hole for laying underground tubes such as, for example, gas pipes, water pipes, etc., or tubes for power-cables, optional or electrical transmission lines, and a lateral hole for draining water.

Previously, to bore an underground lateral hole of relatively small diameter a lateral hole boring apparatus is placed in a vertical hole extending downwardly from the surface of the ground, so that the operator entering the vertical hole operates the lateral hole boring apparatus while manually coupling a plurality of augers to each other.

This previously proposed excavation process requires boring a vertical hole of a size large enough for the operator to enter and stay therein for performing necessary operations, and, consequently, a large volume of earth must be removed from under the ground to form the vertical hole, thereby resulting in increasing the overall construction time, labor and expenses.

When gas pipes, water pipes, etc., are laid underground, an open-cut process may be employed without boring a lateral hole underground. When work is done to connect to an existing main a new gas pipe for supplying city gas from the main to a property or other establishment, the present practice is to excavate a square vertical hole of about one square meter which leads from the surface of a road which may be paved with asphalt and macadam to the position in which the main is laid. Then, a lateral ditch is dug which extends from the vertical hole to the property to which city gas, water or transmission line is desired to be supplied, and the worker enters the vertical hole to perform the work of connecting a new pipe to the main by connecting joints. Thereafter, a temporarily repairing process is employed to dump the sand into the hole and ditch and pave the road with asphalt, to keep traffic in safe and normal state. After lapse of several days, full-scale road repairing work is done under the supervision of officials responsible for maintaining the road safe for travel, to restore the road to the original conditions prevailing before the work for laying the public utility pipe was undertaken.

The above-described proposed process requires excavation of a large scale to be performed to excavate the vertical hole and lateral ditch in the road thereby raising the problem that the process of excavating, back filling and repairing is time-consuming because the area of the hole and ditch is very large. Additionally, the process requires a large workforce and is expensive to perform. Since the road is torn up on a large scale, the requirements to maintain an uninterrupted flow of traffic and to maintain the road in conditions conforming to the required safety standards must be met, so that repair work should be done twice or temporary repair and full-scale repair should be performed one after the other, as described hereinabove. This further increases the overall costs, time, and workforce necessary to perform the process. More specifically, expenses for doing civil engineering work to lay a new pipe account for 80% of the total expenses, and the period of time required to do the work is seven to ten days from a time the work is commenced to a time the full-scale repair is completed.

The aim underlying the present invention essentially resides in avoiding the problems of the prior art and, for this purpose, a method and apparatus for boring an underground lateral hole is provided which are capable of reducing the time, expenses and workforce required for boring the lateral hole.

Another object of the present invention resides in providing a method and apparatus for an underground lateral hole which are capable of reducing the time, expenses and workforce required for laying pipes underground when used for this purpose.

A still further object of the present invention resides in providing an apparatus for boring an underground lateral hole which makes it possible to avoid the occurrence of a situation in which excavation might be made impossible by objects lying underground.

A further object of the present invention resides in providing an apparatus for boring an underground lateral hole which is provided with auger attaching and detaching means constructed such that attaching and detaching of augers can be readily performed and the requirement of a space for performing the auger attaching and detaching operation does not militate against a reduction in the size of a vertical hole.

In accordance with the present invention, a method of boring an underground lateral hole comprises the steps of preparing a vertical hole of desired depth extending from the surface of the ground into the earth; preparing a lateral hole boring apparatus with a leading auger of a length smaller than the diameter of the vertical hole, and a plurality of coupling augers each of a length smaller than the diameter of the vertical hole. The leading auger is then attached to the lateral hole boring apparatus outside the vertical hole and the lateral hole boring apparatus equipped with the leading auger is lowered into the vertical hole and stopped in a predetermined position in the vertical hole. The lateral hole boring apparatus is then manipulated from the ground level to drive and advance the leading auger to bore a lateral hole and the driving and advancing of the leading auger is stopped when the lateral hole has reached a predetermined length commensurate with the length of the leading auger. The lateral hole boring apparatus is then manipulated from the ground level to detach the leading auger from the lateral hole boring apparatus and the lateral hole boring apparatus is lifted above the vertical hole while leaving the leading auger in the lateral hole. One of the coupling augers is coupled to the lateral hole boring apparatus outside the vertical hole and the lateral hole boring apparatus, equipped with the coupling auger, is lowered into the vertical hole again until it reaches the predetermined position. The lateral hole boring apparatus is manipulated from the ground level to connect the coupling auger to the leading auger left behind in the lateral hole, and the aforesaid above-described steps of manipulating, stopping, lifting and lowering are repeated until the lateral hole has reached a predetermined final length.

Additionally, in accordance with the present invention, it is also possible during the step of manipulating the lateral hole boring apparatus from the ground level, after the lateral hole of the predetermined final length has been formed, to rearwardly move the leading auger and all the coupling augers disposed in the lateral hole a distance corresponding to the length of one coupling auger and to manipulate the lateral hole boring apparatus from the ground level to detach the extremity trailing auger from the rest of the augers, as well as to lift the lateral hole boring apparatus equipped with the extremity trailing auger above the vertical hole while leaving the rest o the augers in the lateral hole, and detach the extremity trailing auger from the lateral hole boring apparatus outside the vertical hole. The lowering lateral hole boring apparatus is then lowered into the vertical hole again until it reaches the predetermined position and the lateral hole boring apparatus is manipulated from the ground level to make the lateral hole boring apparatus grasp the next trailing auger left in the lateral hole, with the above-described steps being repeated until all the augers including the leading auger have been withdrawn from the lateral hole and returned to the ground level.

Advantageously, the method of the present invention may further comprise the step of coupling a flexible pipe to a front end of the leading auger prior to rearwardly moving the leading auger and all the coupling augers left behind in the lateral hole following the formation of the lateral hole of the predetermined final length, whereby the pipe can be simultaneously inserted into the lateral hole as the augers are withdrawn from the lateral hole.

Preferably, the step of preparing a vertical hole of a desired depth extending from the surface of the ground down into the earth may comprise the step of forcing at least one cylindrical casing into the earth from the surface of the ground while excavating to form the vertical hole defined by the casing, but he leading auger and coupling augers each having a length smaller than the inner diameter of said casing.

In accordance with the apparatus of the present invention, frame means is provided which includes a support frame, and a guide frame connected to a lower end of said support frame, with an auger drive means for rotating augers mounted to the guide frame for travelling therealong. Travel means are supported by the frame means for travelling the auger drive means forwardly and rearwardly along the guide frame, with a rotary chuck means mounted to the auger drive means for releasably gripping a rear end of one of the augers and an operating means associated with the auger drive means, travel means, and rotary chuck means for permitting them to be manipulated by the operator on the ground level.

Preferably, the apparatus may further include at least one cylindrical casing for providing a vertical hole defined by an inner wall surface thereof, with the casing having first guide means located on the inner wall surface thereof, and second guide means, located on the support frame and cooperating with the first guide means to vertically guide the support frame in the casing during lowering and lifting thereof.

Preferably, the guide frame may be adjustably connected to the support frame in such a manner that the angle of tilting of the guide frame with respect to the support frame can be changed to thereby vary the angle of tilting of a path of travel for the auger drive means as desired with respect to the support frame.

It is also possible in accordance with the apparatus of the present invention to include auger attaching and detaching means capable of being manipulated by the operator on the ground level for attachment and detachment of a succeeding auger to and from at lest one preceding auger located in the bored lateral hole except at least its rear end.

In accordance with still further features of the invention, a lateral hole boring system as described abaove, including lifting and lowering means operative to move the lateral hole boring apparatus through the vertical hole between a predetermined position at the bottom of the vertical hole and a position above an open end of said vertical hole, with the lifting and lowering means being capable of being operated by an operator on the ground level.

Preferably, the lifting and lowering means may include winch means located over the open end of said vertical hole e and the winch means may be supported on a frame structure located on an upper end of a cylindrical casing defining the vertical hole. The frame structure may include a main frame body of substantially semi-cylindrical configuration, and the winch means may be supported on an upper end of the main frame body through a support frame.

BRIEF DESCRIPTION OF THE DRAWINGS

FIGS. 1A–1G are schematic cross-sectional views of a first embodiment of the method of boring a lateral hole in accordance with the invention, illustrating the manner in which the lateral hole boring operation is performed;

DETAILED DESCRIPTION

Figure 1A:
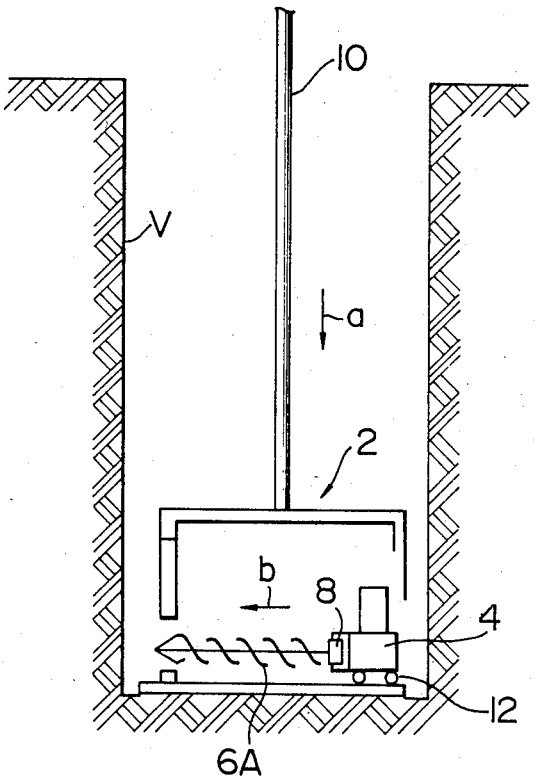

Preferred embodiments of the method of boring a lateral hole underground according to the invention and of the apparatus for boring a lateral hole according to the invention suitable for carrying the method into practice will be described by referring to the accompanying drawings.

Referring now to the drawings wherein like reference numerals are used throughout the various views to designate like parts and, more particularly, to FIG. 1A, according to this figure a preformed vertical hole V may be formed directly by boring or defined by casings which, as hereinbelow described, are forced into the earth. Then, a lateral hole boring apparatus 2 equipped with an auger drive unit 4 which has a leading auger 6A of a length smaller than the diameter of the vertical hole V fitted to a forward end through rotary chuck means 8, is lowered or moved downwardly into the vertical hole V from the ground level in the direction of an arrow a by support means 10, such as, for example, a rod, a wire or a chain until it reaches the bottom of the vertical hole V where it is placed for further operation.

Figure 1B:
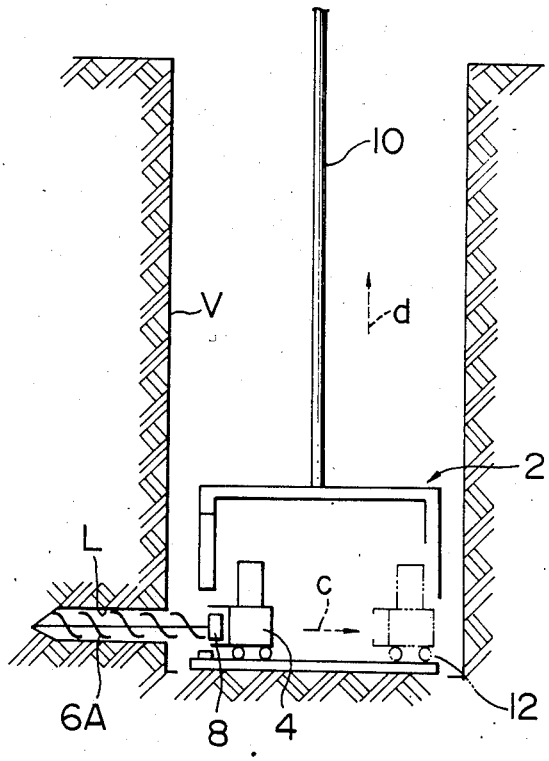

Then, as shown in FIGS. 1A and 1B, the auger drive unit 4 of the lateral hole boring apparatus 2 is positioned at the bottom of the vertical hole V is actuated to rotate the leading auger 6A. A travel device 12 is actuated to forwardly move as indicated by an arrow b, both the leading auger 6A and the auger drive unit 4, to thereby bore a lateral hole L. When the lateral hole L formed by the boring operation reaches a predetermined length which is equal to or slightly smaller than the length of the leading auger 6A, the rotary chuck means 4 and travel device 12 of the lateral hole boring apparatus 2 are deactuated by the operator manipulating the apparatus 2 from the position on the ground level. At the same time, the leading auger 6A is detached from the chuck means 8 by the operator's manipulation on the ground level, and then the auger drive unit 4 is rearwardly moved as indicated by an arrow c in FIG. 1B. Thereafter, the lateral hole boring apparatus 2 is lifted or moved upwardly out of the vertical hole V, as indicated by an arrow d in FIG. 1B.

Figure 1C:
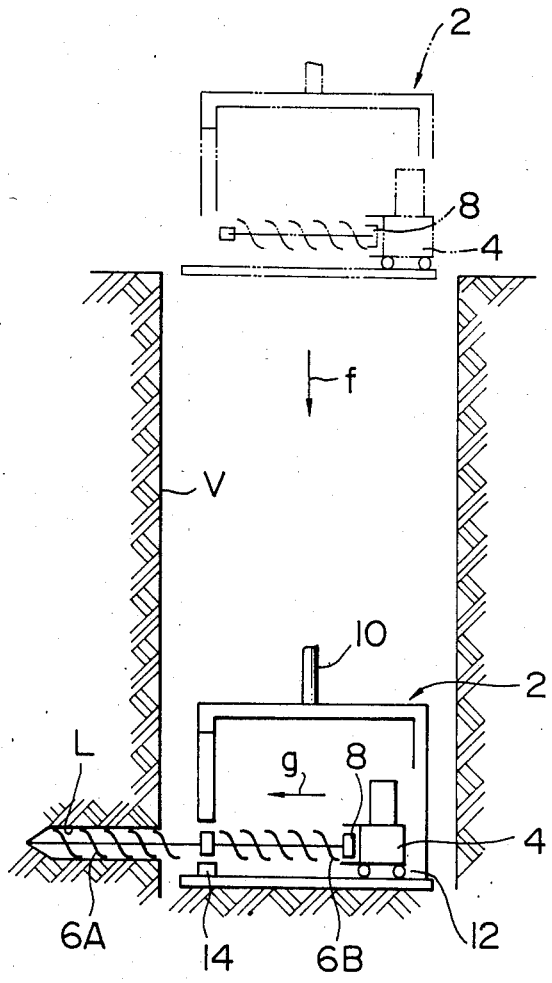
Figure 1D:
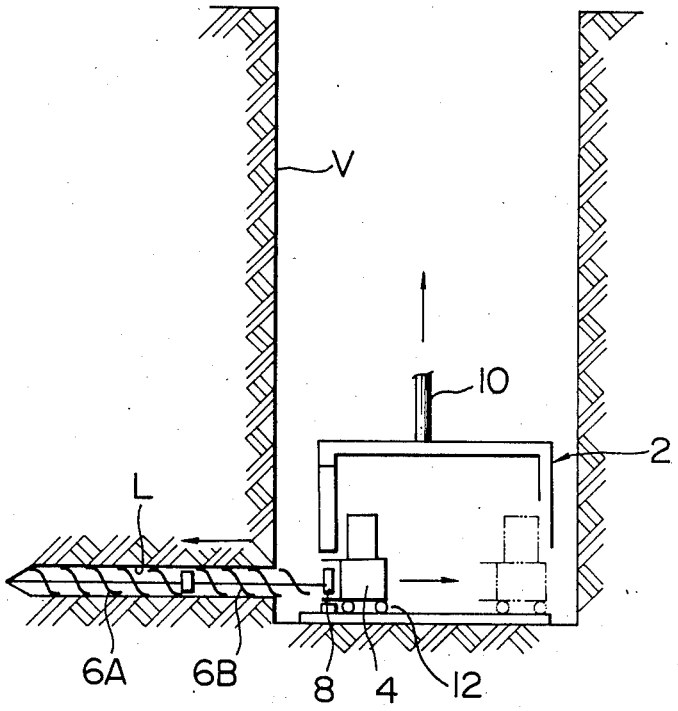

While the lateral hole boring apparatus 2 is kept in an upper position above the open end of the vertical hole V, as indicated by phantom lines e in FIG. 1C, a coupling auger 6B, of a length smaller than the diameter of the vertical hole V, is attached to the rotary chuck means 8. Then, the lateral hole boring apparatus 2 is again moved downwardly in a direction of an arrow f, until it reaches the bottom of the vertical hole V. Fixing chuck means 14 secured to a forward portion of the lateral hole boring apparatus 2 is actuated by the operator positioned on the ground level to grip a rear end of the lading auger 6A remaining in the lateral hole L. The travel device 12 is actuated to forwardly move the auger drive unit 4 in a direction of an arrow g in FIG. 1C in the same manner as the auger drive unit 4 has driver the auger 6A for rotation to perform a boring operation, so as to bring screw thread at a front end of the coupling auger 6B into threadable engagement with a screw thread at the rear end of the leading auger 6A to couple the coupling auger 6B to the leading auger 6A. Thereafter, the fixing chuck means 14 is released from gripping engagement with the rear end of the leading auger 6A, and the travel device 12 is actuated to move the auger drive unit 4 forwardly while allowing the rotating augers 6A and 6B to perform a boring operation to increase the length of the lateral hole L by the boring operation performed by the augers 6A and 6B. The operation steps described in detail hereinabove are repeatedly performed as shown in FIGS. 1D and 1E, so that the augers 6A, 6B, 6C and 6D of a desired number are coupled to the auger drive unit 4 and perform a boring operation to provide the lateral bore L of a predetermined final length.

In withdrawing the augers 6A, 6B, 6C and 6D from the lateral hole L, it is possible to manually pull them by grasping the leading auger 6A when the forward end of the lateral hole L is directed upwardly or when the forward end of the lateral hole L is, as shown in FIG. 1E, extending out of a wall W and the lateral hole L is small in length. When the lateral hole L has a large length, the augers can be pulled out of the lateral hole L by using a power-operated device. However, when it is impossible to withdrawn them from the lateral hole L by pulling at the leading auger 6A, such as when the forward end of the lateral hole L is blocked by a solid object, the augers 6A, 6B, 6C and 6D can be withdrawn from the lateral hole L by utilizing the lateral hole boring apparatus 2 according to the invention, thereby eliminating the use of an additional power-operated withdrawing device.

The operation performed to withdraw the augers by the method according to the invention will be described by referring to FIGS. 1F and 1G. The auger drive unit 4 of the lateral hole boring apparatus 2 is actuated, by the operation at ground level, to rotate the augers in the same direction as when the lateral hole L is formed and the travel device 12 is also actuated to move the auger drive unit 4 rearwardly as indicated by an arrow h in FIG. 1E, so as to rearwardly pull all the augers 6A, 6B, 6C and 6D in the lateral hole L and move the same distance corresponding to the length of one auger or the length of the coupling auger 6D, for example. Then, the rear end of the coupling auger 6C, coupled to the front end of the preceding coupling auger 6D gripped by the rotary chuck means 8, is gripped by the fixing chuck means 14 as shown in FIG. 1F, and the auger drive unit 4 is actuated to rotate in a direction opposite the direction in which it rotated when it causes the augers to perform a boring operation, and the travel device 12 is actuated to move the auger drive unit 4 in a direction indicated by an arrow i in FIG. 1F or rearwardly in the vertical hole V, so that the preceding coupling auger 6D gripped by the rotary chuck means 8 is released from threadable engagement with the succeeding coupling auger 6C. Thereafter, the coupling auger 6C is released from gripping engagement with the stationary chuck means 14. At this time, the lateral hole boring apparatus 2 is moved upwardly to a position above the open end of the vertical hole V as indicated by phantom lines j in FIG. 1F, and the preceding coupling auger 6D is detached from the rotary chuck means 8.

Then, the lateral hole boring apparatus 2 is moved downardly through the vertical hole V to its bottom, and the travel device 12 is actuated to move the auger drive unit 4 forwardly to bring the rotary chuck means 8 into gripping engagement with the rear end of the succeeding coupling auger 6D which serves as a new preceding auger, and thereafter the augers 6A, 6B and 6C can all be moved rearwardly in the same manner as above-mentioned.

Figure 1G:
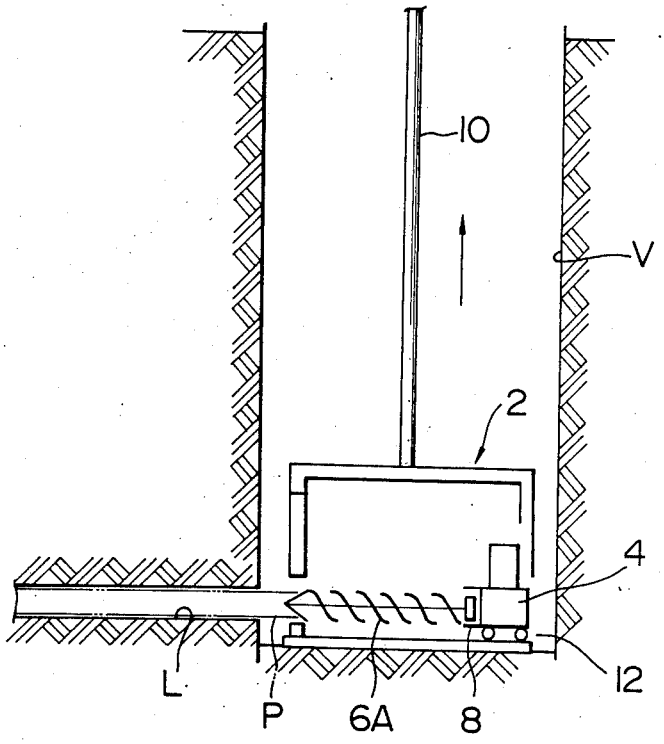

The aforesaid steps are repeated until the last auger 6A have been moved out of the lateral hole I and is returned to the ground level, as shown in FIG. 1G.

When a lateral hole is bored to lay piping underground, a pipe p, formed of flexible material, is fitted and secured to the front end of the leading auger 6A as shown in FIG. 1E, before the augers 6A, 6B, 6C and 6D are moved rearwardly and withdrawn from the lateral hole L as described hereinabove. By this arrangement, as the augers 6A, 6B, 6C and 6D are withdrawn from the lateral hole L, the pipe P can be inserted in the lateral hole L bored by the augers, as shown in FIGS. 1F and 1G.

Figure 2:
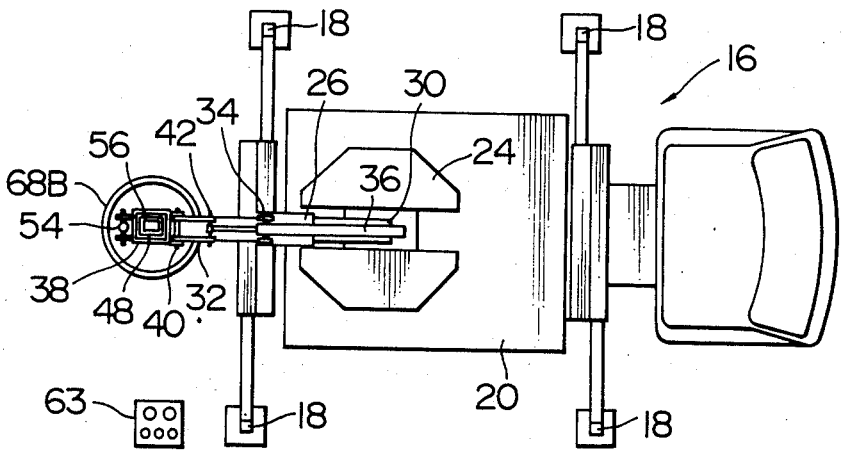
FIG. 2 is a plan view of one example of an apparatus used for the first embodiment of the lateral hole boring method of FIGS. 1A–1G.
Figure 3:
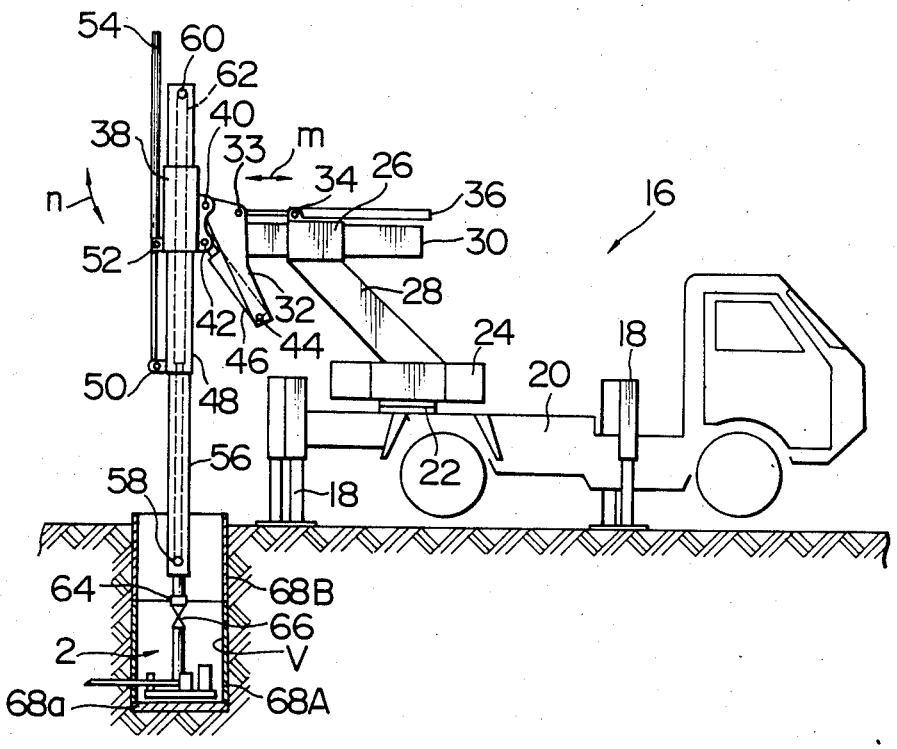
FIG. 3 is a side view of the apparatus of FIG. 2.

In FIGS. 2 and 3, an apparatus for lifting and lowering the lateral hole boring apparatus 2 through the vertical hole V is provided, with the boring apparatus 2 and the apparatus 1G providing one example of the entire system for performing the lateral hole boring method according to the invention. The apparatus 16 includes a truck 20 having four outriggers 18, with the truck 20 supporting, through a swivel ring 22, a swing 24 having connected thereto a support arm 28 supporting a horizontal cylindrical member 26 at its forward end. Slidably fitted in the horizontal cylindrical member 26 is a horizontal arm 30 which is actuated by a hydraulic cylinder 36 connected through pins 33 and 34 to a bracket 32 secured to the forward end of the arm 30 and the cylindrical member 26, respectively, to sliding move-in movement in the direction of an arrow m in FIG. 3.

A support member 38 having a rectangular cross section, is supported at a top end of the bracket 32 in such a manner that the member 38 can be freely tilted about a pin 40 in a direction of an arrow n in FIG. 3 at least from a position in which it is perpendicular to the ground to a position in which it is parallel to the ground. A hydraulic cylinder 46 is connected to the bottom portions of the support member 38 and bracket 32 through pins 42 and 44, respectively, so as to set the support member 38 at a desired tilting position. An outer member 48 of a rectangular cross section is supported in the support member 38 in such a manner that it is slidably moved by a hydraulic cylinder 54 connected to the members 38 and 48 through pins 50 and 52, respectively. An inner member 56, of rectangular cross section, is held in the outer member 48 in such a manner that the inner member 56 can be telescopically moved into and out of the outer member 48 by a hydraulic cylinder 62 connected at opposite ends to a lower end of the inner member 56 and an upper end of the outer member 48 through pins 58 and 60, respectively.

A hydraulic pump, supported on the truck 20, may be used for supplying hydraulic fluid, under pressure, to the hydraulic cylinders 36, 54 and 62 and to a drive unit for the swivel ring 22. An operation device 63 for operating, from the ground level, the hydraulic cylinders 36, 54 and 62 and the swivel ring 22 is located in the vicinity of the vertical hole V as shown in FIG. 2. Wires and lines (not shown) are provided for connecting the operation device 63 to the hydraulic cylinders 36, 54 and 62 and the drive unit for the swivel ring 22.

Figure 5:
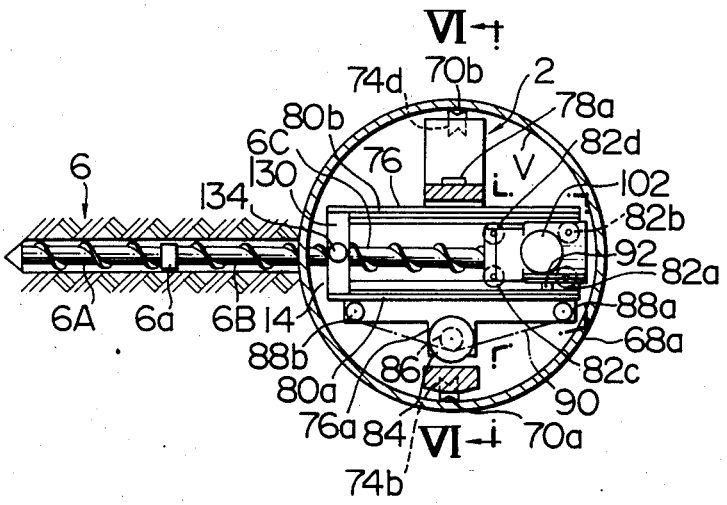
FIG. 5 is a sectional view taken along the line V—V in FIG. 4.
Figure 6:
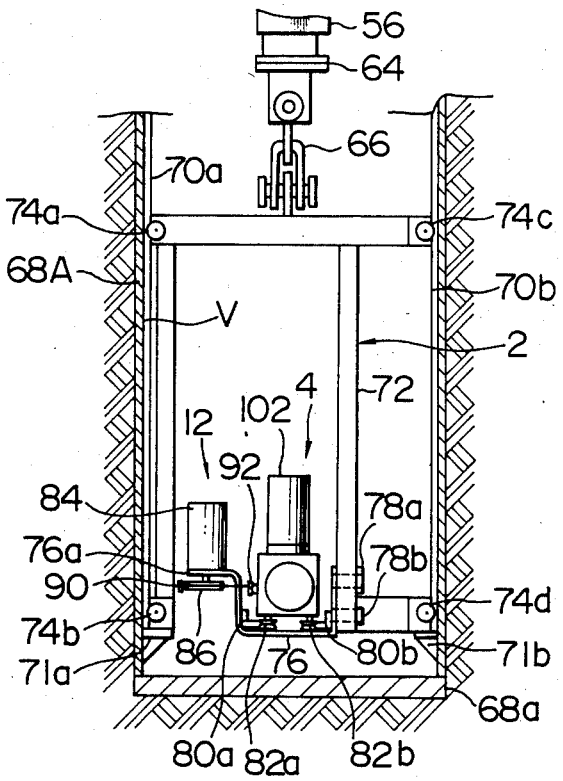
FIG. 6 is a sectional view taken along the line VI—VI in FIG. 5.

The inner member 56 which provides the support means 10 has a flange 64 and a universal joint 66*a* at its lower end for supporting the lateral hole boring apparatus 2. In the embodiment of FIGS. 2 and 3, a casing 68A is fitted in a vertical hole, and an additional casing 68B is placed on top of the casing 68A, so as to define the vertical hole V by the two casings 68A and 68B. The casing 68A has a bottom wall 68*a* at the lower end, but the bottom wall 68*a* may be eliminated as with the other embodiments described hereinbelow. Two guide rails 70*a* and 70*b* for guiding the lateral hole boring apparatus 2 when it is moved upwardly and downwardly in the vertical hole V are located on an inner wall surface of the casings 68A and 68B in diametrically opposed positions and extend vertically from top to bottom of the casings 68A and 68B (FIGS. 5 and 6). Stoppers 71*a* and 71*b*, for holding the lateral hole boring apparatus 2 in a predetermined position at the bottom of the vertical hole V, are secured to a lower end of the inner wall surface of the casing 68A (see FIG. 6).

When the system of the above described construction is used, the hydraulic cylinder 36 is actuated to bring the lateral hole boring apparatus 2 to a position in which it is located substantially in a central portion of the vertical hole V. Then, the hydraulic cylinders 54 and 62 are actuated to move the lateral hole boring apparatus 2 upwardly and downwardly in the vertical hole V. As means for lifting the lateral hole boring apparatus 2, the hydraulic cylinders 54 and 62 may be replaced by a winch or a rack-and-pinion arrangement.

Figure 4:
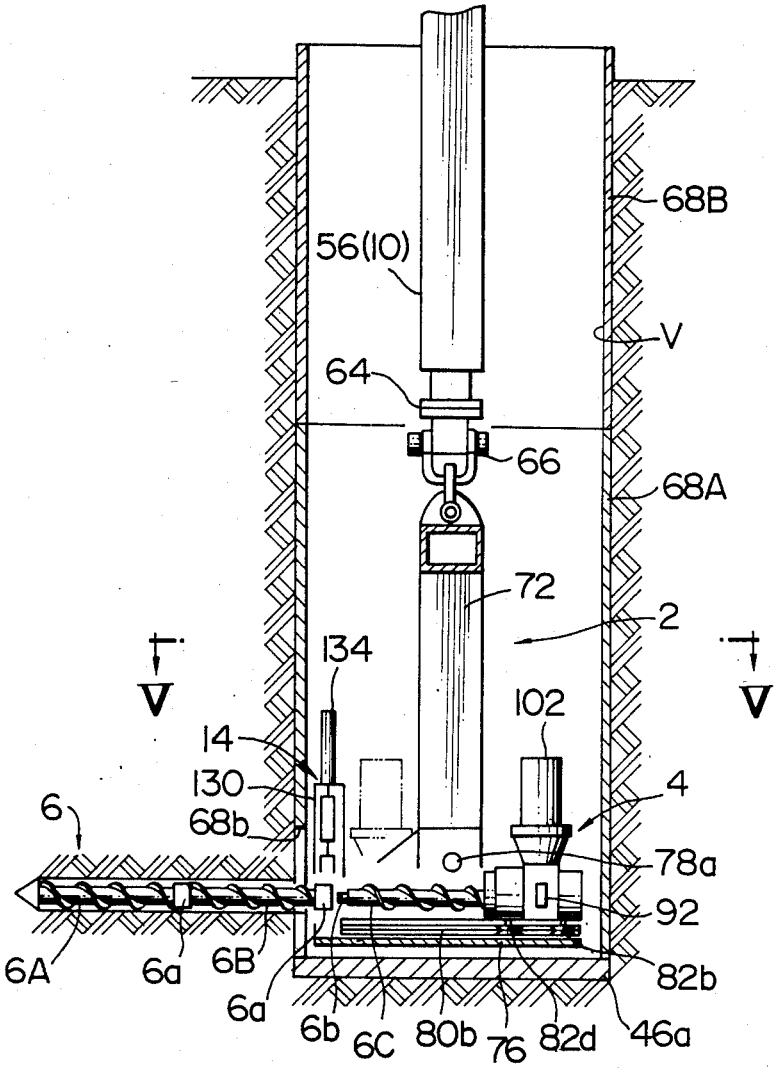
FIG. 4 is a partially schematic side view of a first embodiment of the apparatus for boring a lateral hole suitable for carrying into practice the first embodiment of the method for boring a lateral hole according to the invention.

In the embodiment of FIGS. 4–6, the boring apparatus 2 includes support means having a support frame 72, of a substantially gate shape, depending from the inner member 56 through the flange 64 and universal joint 66. Guide rollers 74*a*, 74*b*, 74*c* and 74*d* are attached to upper and lower end portions of the support frame 72 in positions in which they can rollingly move along the pair of guide rails 70*a* and 70*b* located on the inner wall surface of the casings 68A and 68B. A guide frame 76, supporting the lateral hole boring apparatus 2 for movement in a direction perpendicular to the length of the vertical hole V, is connected to the support frame 72 through pins 78*a* and 78*b* in such a manner that the guide frame 76 is oriented in a direction perpendicular to an imaginary line connecting the guide rails 70*a* and 70*b* together toward a slit 68*b* formed in the casing 68A to allow augers to pass therethrough. The guide frame 76 has a pair of guide rails 80*a* and 80*b* serving as travel paths which extend along its length which is perpendicular to the length of the vertical hole V. The guide rails 80*a* and 80*b* are fitted in grooves formed at outer peripheries of guide rollers 82*a*, 82*b*, 82*c* and 82*d* secured to a bottom of the auger drive unit 4 in four corners thereof, so that the auger drive unit 4 can be positioned and moved along the guide rails 80*a* and 80*b*.

The travel device 12 for moving the auger drive unit 4 forwardly and rearwardly is constructed as follows. The guide frame 76 has an extension 76*a* which supports a hydraulic motor 84 for moving the auger drive unit 4. A chain 90, trained over a sprocket wheel 86 driven for rotation by the hydraulic motor 84 and sprocket wheels 88*a* and 88*b* mounted to opposite ends of the extension 76*a*, is connected to a connection 92 located at one side of the auger drive unit 4. Thus, as the hydraulic motor 84 is actuated, the auger drive unit 4 can be moved forwardly and rearwardly along the guide rails 80*a* and 80*b*.

Figure 7:
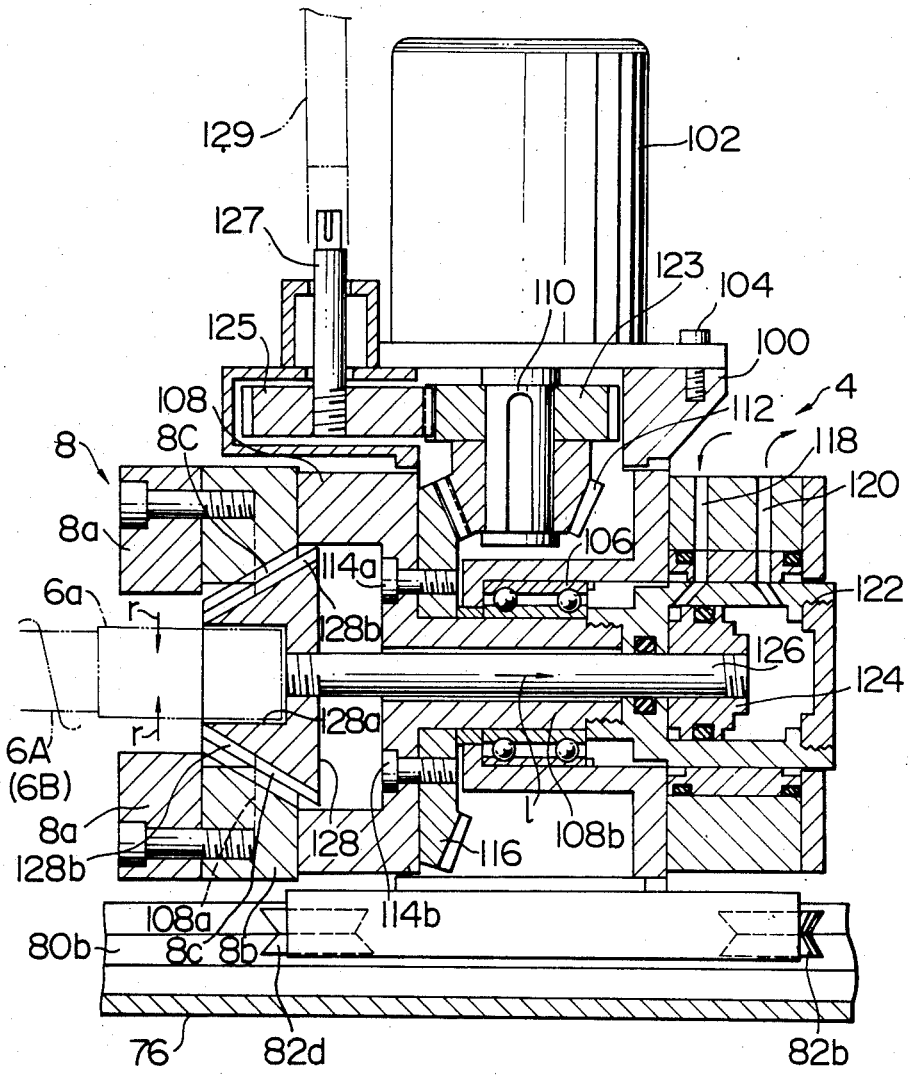
FIG. 7 is a sectional side view of the auger drive unit of the apparatus for boring a lateral hole shown in FIG. 4.

The auger drive unit 4 and rotary chuck means 8 are constructed as shown in FIG. 7. A main body 100 has rotating hydraulic motor 102 secured to its upper portion through a bolt 104, and a rotary member 108 is journalled by a bearing 106 secured to the main body 100 for rotation. The hydraulic motor 102 has an output shaft 110 supporting a bevel gear 112 which is maintained in meshing engagement with another bevel gear 116 secured to the rotary member 108 through bolts 114*a* and 114*b*, and the rotary member 108 supports the rotary chuck means 8 adapted to grip a connection 6*a* at rear end of one of the augers 6A, 6B, 6C . . . (hereinafter generally designated by 6). The rotary chuck means 8 includes a plurality of gripping claws 8*a* each secured to a sliding portion 8*b* formed at its base and slidably fitted in wedge-shaped grooves 108*a* formed radially in the rotary member 108. By this arrangement, the rotary chuck means 8 can be freely moved in a direction of an arrow r in FIG. 7 (which is perpendicular to the center of rotation of the rotary member 108).

In the rotary chuck means 8 there is provided clamping means comprising a hydraulic cylinder 122 integrally formed with the rotary member 108 adapted to be supplied with and discharge working fluid through ports 118 and 120, a rod 126 connected to a piston 124 for the hydraulic cylinder 122 and movably extending through a cylindrical bore 108*b* of the rotary member 108, and a clamp 128 of a conical shape secured to a forward end of the rod 126. The clamp 128 is formed with an opening 128*a* for receiving the connection 6*a* at the rear end of the auger 6, and wedge-shaped grooves 128*b* formed along inclined surfaces of the outer peripheries of clamp 128 in positions corresponding to the claws 8*a*. The gripping claws 8*a* each have a sliding portion 8*c* which is slidably fitted in one of the wedge-shaped grooves 128*b*. In this construction, as working fluid is supplied through the port 118 to a rod side chamber of the hydraulic cylinder 122, the piston 124, rod 126 and clamp 128 move in the direction of an arrow l in FIG. 7, and the wedge-shaped grooves 128*b* are brought into engagement with the sliding portions 8*c* of the gripping claws 8*a*, thereby resulting in the gripping claws 8*a* moving in the direction of the arrow r to thereby clamp the connection 6*a* at the rear end of the auger 6 which is inserted in the opening 128*a* of the clamp 128. At this time, actuation of the hydraulic motor 102 causes the rotary member 108 to rotate together with the hydraulic cylinder 122 and rotary chuck means 8 to thereby rotate the auger 6 in a boring direction. When the working fluid is introduced into a bottom side chamber of the hydraulic cylinder 122 through the port 120, the gripping claws 8*a* move in the direction opposite to the arrow r to allow the auger 6 to be released from the rotary chuck means 8.

A gear 123 may be attached to the output shaft 110 of the hydraulic motor 102 with the gear 123 meshing with another gear 125 attached to a shaft 127 to which a flexible shaft 129 rotated by manipulating a handle, not shown, located on the ground level can be connected or disconnected. This allows the auger 6 to be rotated by the operator who manipulates the handle on the ground level, so that the operator is capable of performing a boring operation while ascertaining by the feel of the hand whether there is an obstruction lying ahead of the auger 6.

Figure 8:
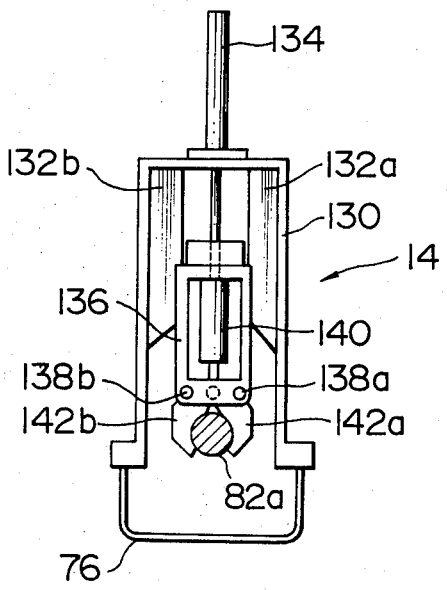
FIGS. 8 and 9 are front views of a stationary chuck means of the apparatus for boring a lateral hole shown in FIG. 4, showing the stationary chuck in a position in which it grips an auger and in a position in which it has released the auger, respectively.
Figure 9:
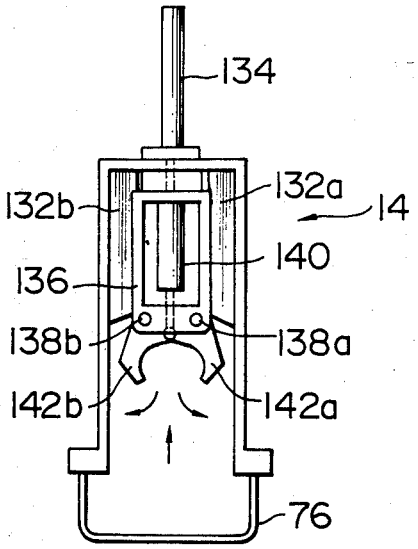

The fixing chuck means 14 for use in attaching and detaching augers 6 is located at one end portion of the guide frame 76 and comprises, as shown in FIGS. 8 and 9, a gate-type support frame 130, secured on the guide frame 76, a movable frame 136, movable along guides 132*a* and 132*b* located inside the support frame 130, secured on the guide frame 76, a movable frame 136, movable along guides 132*a* and 132*b* located inside the support frame 130 for vertical movement as a hydraulic cylinder 134 disposed at an upper portion of the frame 130 is actuated, and auger gripping claws 142*a* and 142*b* supported on left and right sides of a lower end portion of the movable frame 146 for pivotal movement about pins 138*a* and 138*b*, respectively, so that the claws 142*a* and 142*b* can be opened and closed by the action of a hydraulic cylinder 140 supported by the movable frame 136.

The hydraulic motors 102 and 84 and hydraulic cylinders 122, 134 and 140 are connected, through their hydraulic hoses (not shown), with the operation device 63 (FIG. 2) and then with a source of hydraulic fluid located on the truck 20, so that their operation can be controlled by the operator positioned on the ground level.

In boring a lateral hole by using the lateral hole boring apparatus 2, the hydraulic cylinders 54 and 62 shown in FIG. 3 are contracted to lift the inner member 56, and the lateral hole boring apparatus 2 is connected to the inner member 56. The auger drive unit 4 is moved to a rearward position, and the rod 126 of the hydraulic cylinder 122 shown in FIG. 7 is brought to an extended position as shown in FIG. 7. Then, the leading auger 6A which may be formed of a solid or hollow rod and has a sharp point at the front end and a screw connection 6*a* at the rear and while provided with spiral cutting edges is fitted at the connection 6*a* in the opening 128*a* of the clamp 128, and the hydraulic fluid or working fluid is supplied through the port 118 into the rod side chamber of the cylinder 122 to move the piston 124 in the direction of the arrow shown in FIG. 7. This moves the gripping claws 8*a* in the direction of the arrow r to grip the connection 6*a* of the leading auger 6A by the gripping claws 8*a*. The angle of swinging movement of the swing 24, the distance covered by the extending horizontal arm 30, and the tilting angle of the outer and inner members 48 and 56 are adjusted to bring the guide rollers 74*a*, 74*b*, 74*c* and 74*d* of the apparatus 2 into alignment with the guide rails 70*a* and 70*b* of the casings 68A and 68B. The hydraulic cylinder 54 is extended to fit the guide rollers 74*a*, 74*b*, 74*c* and 74*d* of the apparatus 2 in the guide rails 70*a* and 70*b* and then the hydraulic cylinders 54 and 62 are extended to move the apparatus 2 downwardly in the vertical hole V until the lower end of the support frame 72 is brought into abutting engagement with the stoppers 71*a* and 71*b* at the lower end of the inner wall surface of the casing 68B and stops. At this time, the fixing chuck means 14 remains in an upper position shown in FIG. 9 so that it may not interfere with the movement of the leading auger 6A. Then, the hydraulic motor 84, for moving the drive unit 4 rear, is actuated by the operator positioned on the ground level to forwardly move the auger drive unit 4. At the same time, the hydraulic motor 102 for rotating the auger 6A is actuated, so that the leading auger 6A passes through the slit 68*b* formed at a lower end of the casing 68A and enters the earth to bore a hole. At this time, a force exerted by the leading auger 6A produces a reaction which is borne by the wall of the casings 68A and 68B or the vertical hole V through the guide frame 76, support frame 72, guide rollers 74*a*, 74*b*, 74*c* and 74*d* and guide rails 70*a* and 70*b*.

After the auger drive unit 4 has been moved to a foremost position (as ascertained with the naked eyes or by means of a sensor), the working fluid is supplied through the port 120 shown in FIG. 7 into the bottom side chamber of the cylinder 122 to release the rotary chuck means 8 from gripping engagement with the connection 6*a* of the leading auger 6A and the hydraulic motor 84 is actuated to move the auger drive unit 4 rearwardly 84 until it reaches a rearmost position. Soil accumulated at the bottom of the vertical hole V as the auger drive unit 4 moves forwardly as described hereinabove is drawn by suction through a hose connected to a suction pump, not shown, and delivered to the ground level.

Thereafter, the hydraulic cylinders 54 and 62 are contracted to move the apparatus 2 upwardly above the open end of the vertical hole V, and the coupling auger 6B which may be formed of a solid or hollow rod and has a male screw type connection 6*b* at the front end and the female screw type connection 6*a* at the rear end while being provided with spiral cutting edges is gripped at the rear end by the rotary chuck means 8 in the same manner as described by referring to the leading auger 6A. Then, the hydraulic cylinders 54 and 62 are extended to move the apparatus 2 downwardly into the vertical hole V. Thereafter, the hydraulic cylinder 134 of the fixing chuck means 14 is extended and the hydraulic cylinder 140 is contracted to cause the claws 142*a* and 142*b* to grip the connection 6*a* at the rear end of the leading auger 6A. The hydraulic motor 84 for the auger drive unit 4 is actuated to move the auger drive unit 4 forwardly, at the same time the hydraulic motor 102 is actuated to bring the connection 6*a* at the front end of the coupling auger 6B which is the male screw type connection 6*a* into threadable engagement with the connection 6*b* at the rear end of the leading auger 6A through screw type connection 6*b* to thereby couple them together. Thereafter, the hydraulic cylinder 140 of the fixing chuck means 14 is extended to release the claws 142*a* and 142*b* from gripping engagement with the connection 6*a* at the rear end of the leading auger 6A, and the hydraulic cylinder 134 is contracted to upwardly move the movable frame 136. Actuation of the hydraulic motors 84 and 102 causes the drive unit 4 to move forwardly while rotating so as to further bore the later hole. The aforesaid operations are repeatedly performed until the length of the lateral bore L reaches a predetermined final value.

After finishing the boring operation the lateral hole L, the hydraulic motor 84 for the auger drive unit 4 is actuated to move the auger drive unit 4 to the rear position while allowing the hydraulic motor 102 to rotate the auger drive unit 4 in the same direction as it is rotated when a boring operation is performed. The connection 6*a* at the rear end of the succeeding auger which may be the auger 6B that is partly exposed in the vertical hole V is gripped by the fixing chuck means 14, and the hydraulic motor 102 is actuated to rotate in a direction opposite the direction in which it rotates when a boring operation is performed to rotate the preceding auger 6C gripped by the rotary chuck means 8, to thereby release the auger 6C gripped by the rotary chuck means 8 and the auger 6B gripped by the fixing chuck means 14 from the threadable engagement with each other. After the stationary chuck means 14 is released from gripping engagement with the auger 6B, the hydraulic cylinders 54 and 62 are contracted to move the apparatus 2 upwardly above the upper open end of the vertical hole V. Then, the rotary chuck means 8 is released from gripping engagement with the auger 6C, and the apparatus 2 is again moved downwardly into the vertical hole V. The rotary chuck means 8 grips the connection 6*a* of the next preceding auger, which may be the auger 6B, that is exposed in the vertical hole V and the auger 6B is withdrawn from the lateral hole L in the same manner as the auger 6C. Where there are some augers till remaining underground, the preceding auger 6B is detached from the succeeding auger which may be the auger 6A, and moved upwardly to the ground level. These operations are repeatedly performed until all the augers used for boring the lateral hole L are moved out of the lateral hole L to the ground level.

The hydraulic motors 102 and 84 and the hydraulic cylinders 122, 134 and 140 can be connected to a source of hydraulic fluid separate from the source of hydraulic fluid on the truck 20. The hydraulic devices may be replaced by electric motors as means for supplying drive force to the various parts of the apparatus for carrying the method according to the invention into practice.

In the first embodiment of the invention described hereinabove, the casings 68A and 68B are used and the stoppers 71*a* and 71*b* are provided to the lower portion of the casing 68A to regulate the position of the lateral hole boring apparatus 2 at the bottom of the vertical hole V. The stoppers 71*a* and 71*b* may be constructed to have their positions adjusted, and the slit 68*b* for the auger to pass therethrough may be formed to extend through the entire length of the casings 68A and 68B. By this arrangement, the height of the lateral hole formed by tha apparatus 2 may be set at any level as desired.

When such a lateral hole boring operation is performed, the cross-sectional area of the vertical hole V extending from thr ground level down into the earth a predetermined depth can be made smaller than has previously been the case (when the vertical hole is circular and has a diameter of 50 cm, for example, the cross-sectional area of this vertical hole is about ¼ that of a conventional vertical hole of about 1 m in diameter).

When the above described embodiment of the invention is carried into practice, the vertical hole V of a predetermined depth from the ground level may not necessarily be cylindrical, and it may be either square or polygonal. An increase in the cross-sectional area of the vertical hole V is disadvantageous in that the volume of the earth removed by boring proportionately increases to the increase in the cross-sectional area, thereby causing an increase in road damage. However, it offers the advantage that the length of a lateral hole that is formed by one auger 6 can be increased. A vertical hole of a circular shape which would enjoy this advantage while minimizing road damage to such an extent that no temporary repair is necessary preferably has a diameter smaller than 70 cm and greater than 40 cm. More preferably, the diameter range would be 45–60 cm which would make it impossible for the operator to do work while stooping down. When the vertical hole is polygonal in shape, the dimensions of the hole, as viewed from different directions, would preferably be similar to those of the circular vertical hole. However, by forming the polygonal vertical hole in such a manner that the dimension of the hole as measured in a direction in which the auger 6 is moved forwardly and rearwardly is greater than 70 cm and its dimension, as measured in a direction perpendicular to the direction in which the auger is moved forwardly and backwardly, is smaller than 40 cm, the distance covered by the movement of the auger 6 could be increased while reducing the cross-sectional area of the vertical hole. Also, the vertical hole V may be tilted with respect to the ground.

A second embodiment of the lateral hole boring method in accordance with the invention will now be described as being applied to the boring of a lateral hole for laying a gas service pipe to be connected to an existing gas main.

The second embodiment of the lateral hole boring method includes operation steps which are followed substantially in the order shown in FIGS. 10A–10K. In this method, the operation for providing the vertical hole V and the operation for backfilling the vertical hole after boring of the lateral hole are conducted by using the machine shown in FIGS. 2 and 3 and used for lifting and lowering the lateral hole boring apparatus 2 in the first embodiment.

Figure 10A:
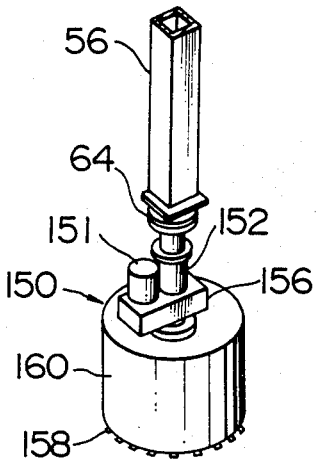
FIG. 10A–10K are views in explanation of a second embodiment of the method of boring a lateral hole in accordance with the invention, showing the manner in which the lateral hole boring operation is performed.

A hole saw 150 shown in FIG. 10A is connected to the flange 64 at the lower end of the inner member 56 of the machine shown in FIGS. 2 and 3 to cut a surface layer S in a circle of about 50 cm in diameter and bore a hole in a macadam layer R as a preliminary step. The hole saw 150 includes a drum-shaped cutter 160 with bits 158 which is rotated through a gearing 156 by a hydraulic motor 164 while supplying water through a water injector 152 to a portion of the ground which is being cut. Before the hole is cut as a preliminary step by the hole saw 150, a probing instrument and a metal sensor are used to detect the position in which boring is to be performed. As the operator actuates buttons or switches on a control panel, not shown, located in the vicinity of the position in which boring is to be performed, the hydraulic cylinders 36, 46, 54 and 62 are rendered operative to bring the hole saw 150 into index with a point on the surface of the road which is located above the existing underground main Q. At this time, the angel of the inner member 56 can be adjusted by manipulating the hydraulic cylinder 46 so as to bring the entire surface of the cutter 158 of the bit 160 into contact with the surface of the road even if the road is sloping to thereby satisfactorily perform a cutting operation.

Figure 10B:
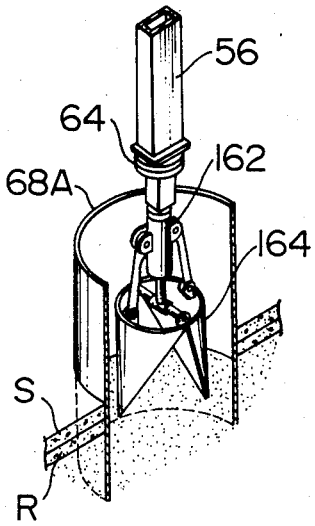
Figure 10C:
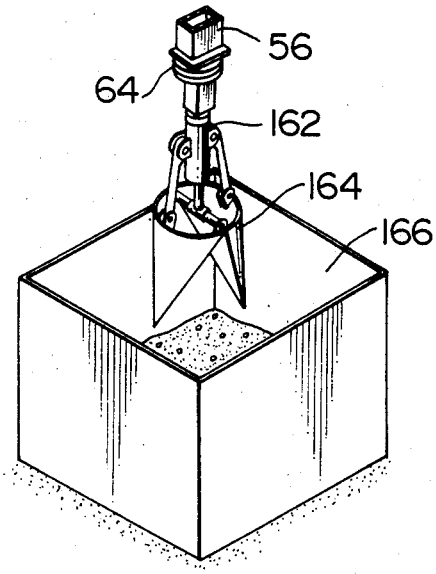
Figure 10D:
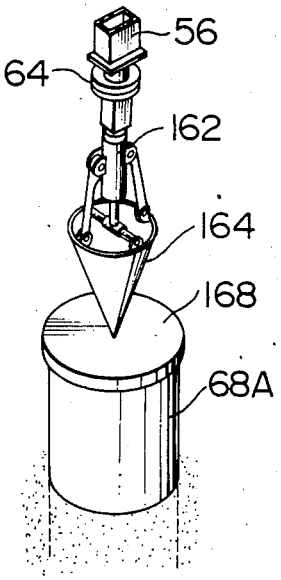
Figure 10E:
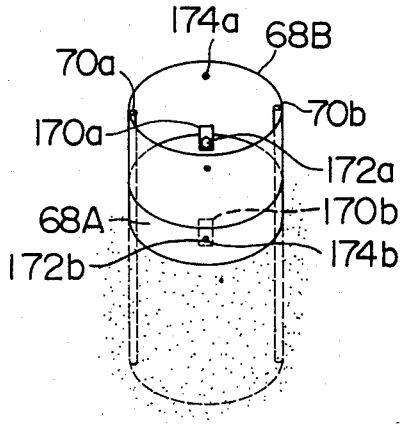

Then, as shown in FIG. 10B, the cylindrical casing 68A is forcefitted in the preliminary formed hole, and a bucket 164 having a hydraulic cylinder 162 for opening and closing the bucket 164 is connected to the flange 64 of the inner member 56 to remove the earth inside and below the casing 68A and store same in a box 166 shown in FIG. 10C which is located in the vicinity of the site of excavation. When the excavation work has shown some progress, a lid 168 is placed on the casing 68A as shown in FIG. 10D and the hydraulic cylinder 54 is extended to force the casing 68A to move downwardly through the bucket 164. Then, as shown in FIG. 10E, the casing 68B is placed on the casing 68A, and bolts **172*a* and 172*b*, inserted in connections 170*a* and 170*b* secured to the upper casing 68B, are threadably fitted in openings 174 and 174*b* formed in the lower casing 68A to connect the two casings 68A and 68B together. The pair of guide rails 70*a* and 70*b* are located on the inner wall surface of the casings 68A and 68B and extending vertically in positions diametrically opposed to each other as described hereinabove for guiding the movement of the lateral hole boring apparatus 2 into and out of the vertical hole V. Although not shown, a boss is formed at the upper edge of the lower casing 68A, and the boss is adapted to be fitted in an aperture formed in the lower edge portion of the upper casing 68B so as to bring the guide rails 70*a* and 70*b* of the upper and lower casings 68B and 68A** into alignment with each other.

Figure 10F:
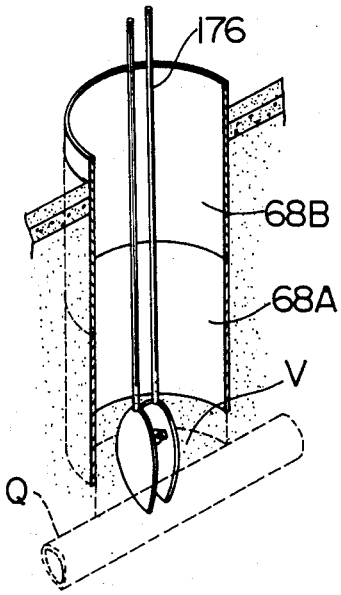
Figure 11:
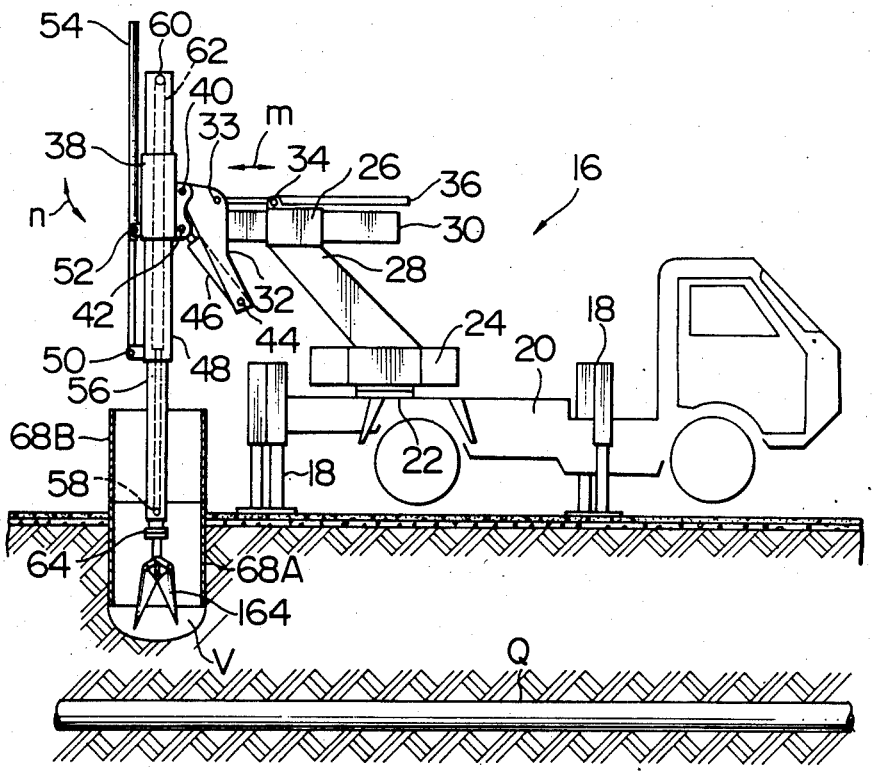
FIG. 11 is a side view of one example of an apparatus used when the second embodiment of the lateral hole boring method shown in FIGS. 10A–10K is carried into practice.

Then, the earth inside and below the casing 68A is removed by the bucket 164, as shown in FIG. 11. When the excavation work is performed until the bottom of the vertical hole V reaches an existing main Q as shown in FIG. 10F, a manually-operated excavator 176 is used to remove earth to expose both sides of the existing main Q without damaging the same.

Figure 12:
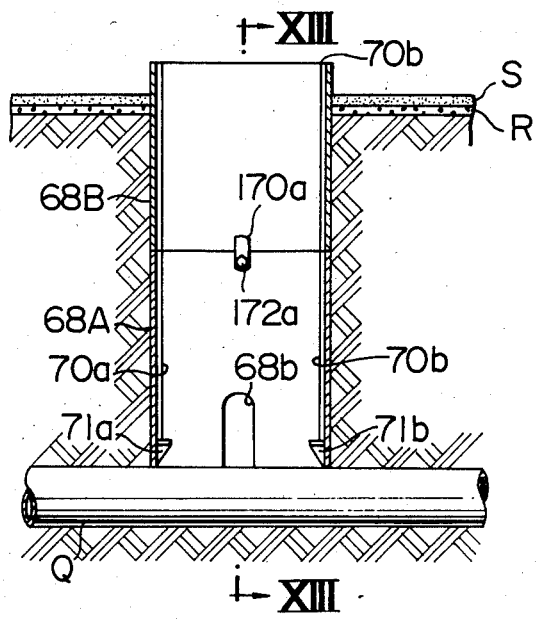
FIG. 12 is a sectional view of the vertical hole after the casing is fitted therein, when the second embodiment of the lateral hole boring method according to the invention is carried into practice.
Figure 13:
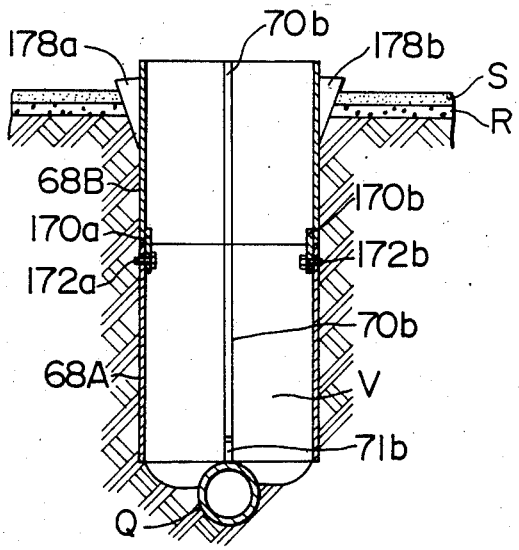
FIG. 13 is a sectional view taken along the line XIII—XIII in FIG. 12.
Figure 14:
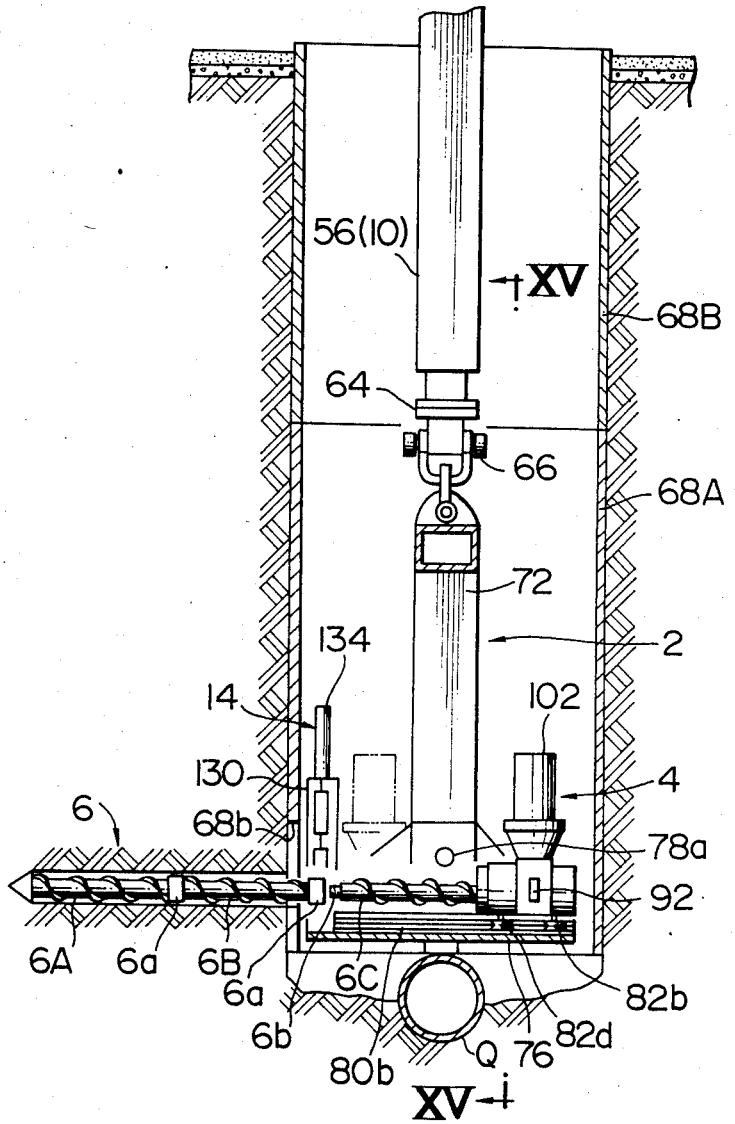
FIG. 14 is a sectional side view of the apparatus for boring a lateral hole suitable for carrying out the second embodiment of the method according to the invention, showing the manner in which the lateral hole boring operation is performed in accordance with the second embodiment of the method.
Figure 15:
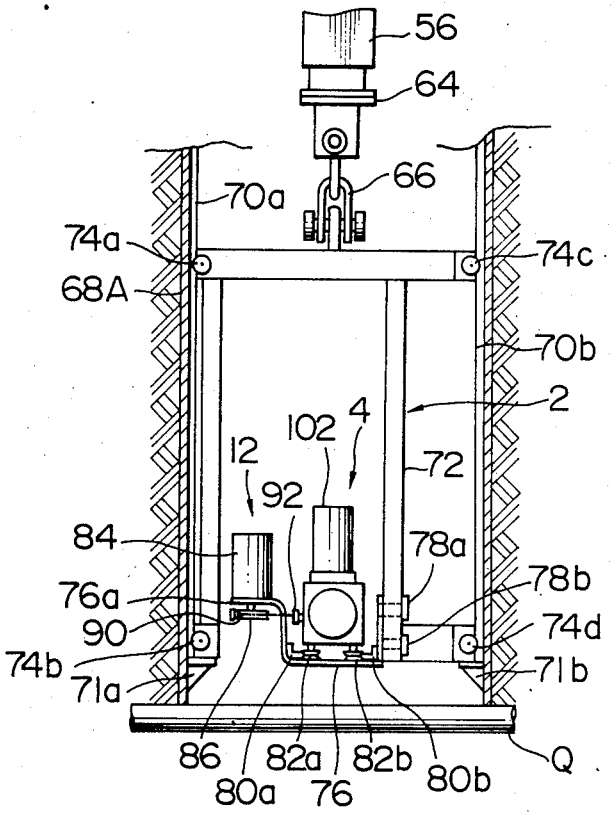
FIG. 15 is a sectional view taken along the XV—XV in FIG. 14.
Figure 16:
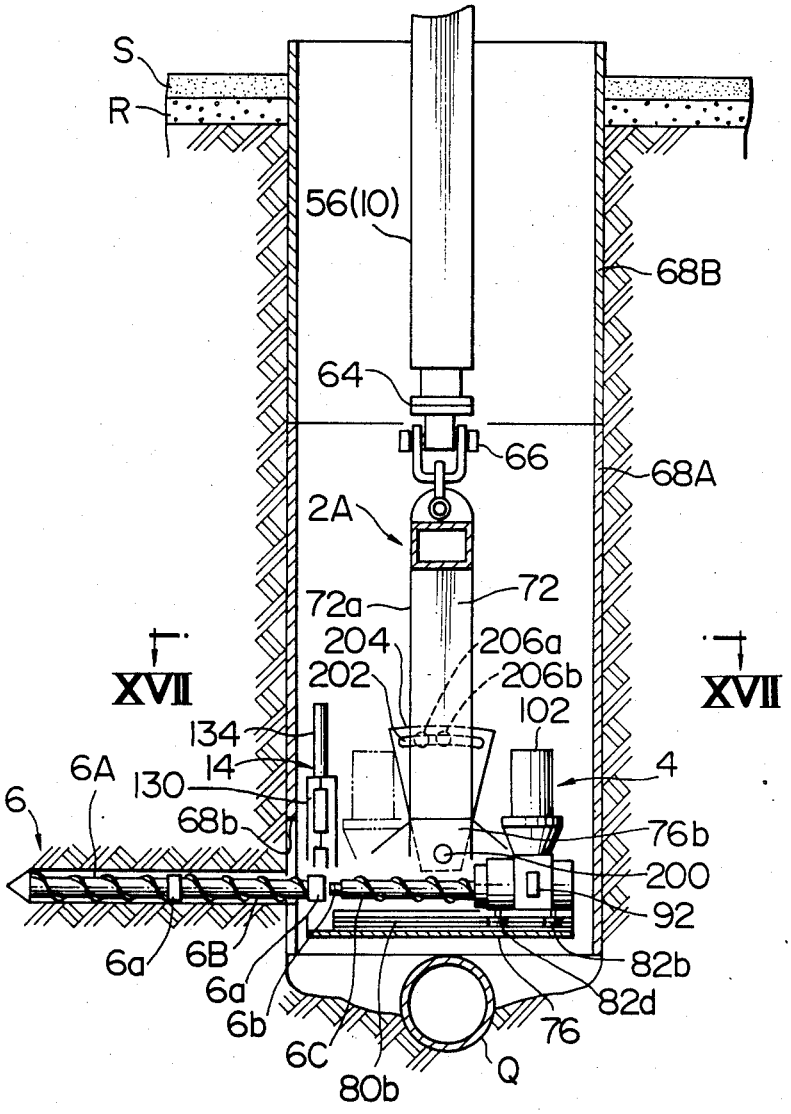
FIG. 16 is a vertical sectional view of a second embodiment of the apparatus for boring a lateral hole suitable for carrying the second embodiment of the method of boring a lateral hole according to the invention of boring a lateral hole according to the invention into practice.
Figure 17:
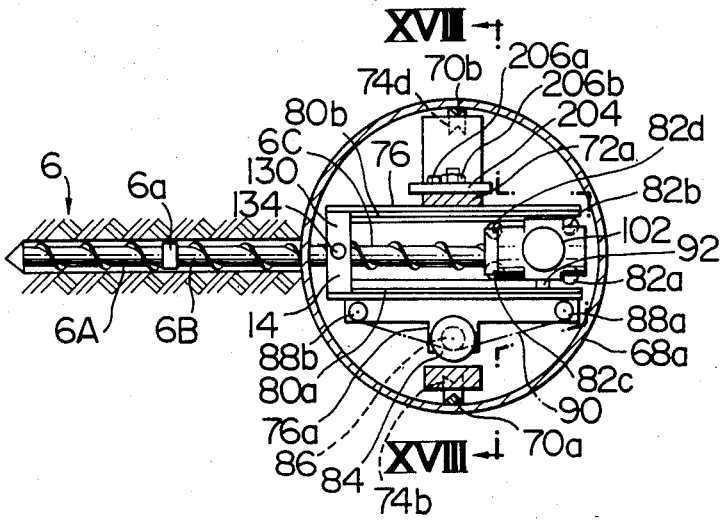
FIG. 17 is a sectional view taken along the line XVII—XVII in FIG. 16.
Figure 18:
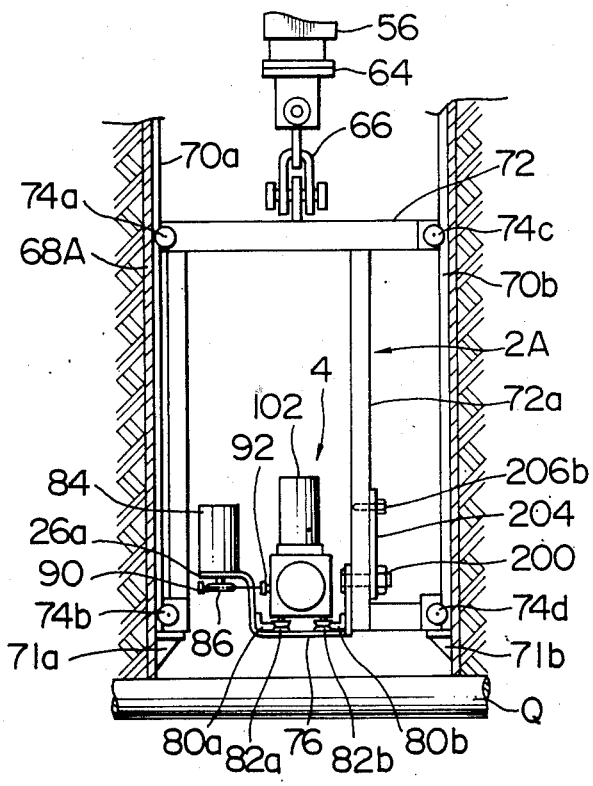
FIG. 18 is a sectional view taken along the line XVIII—XVIII in FIG. 17.

FIGS. 12 and 13 show the vertical hole V formed as the result of the excavation work described hereinabove. As shown, the vertical hole V is formed by forcing the casings 68A and 68B into the ground. However, this depth is not restrictive, and only one casing or more than three casings may be used for forming a vertical hole. The casings may be of the same length. However, in actual practice, to provide the vertical hole V of the desired depth, the number of casings used for forming a vertical hole of a given depth can be reduced if casings of different lengths are prepared and used in a suitable combination. When the two casings 68A and 68B are used, further downward movement of the casings 68A and 68B is avoided as the lower casing 68A abuts against the existing underground main Q to thereby accurately position the casings 68A and 68B. After the casings 68A and 68B have been forced into the ground to form the vertical hole V, they are secured in place by inserting wedges **178*a* and 178*b* between the upper casing 68B and the ground as shown in FIG. 13**.

Figure 10G:
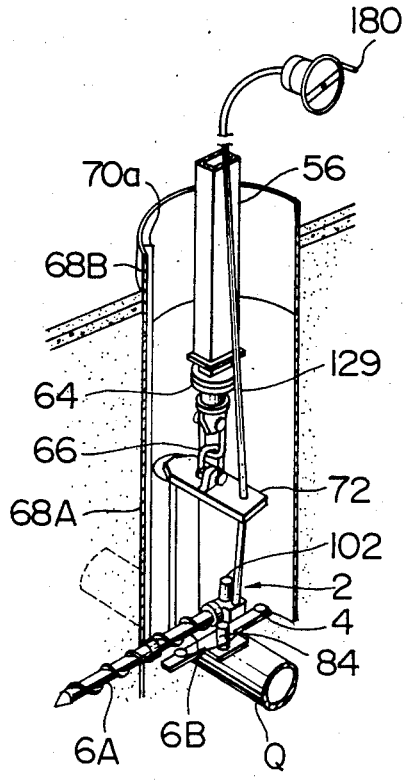

Then, as shown in FIG. 10G, a boring tool, such as a screw auger 6A, is attached to the lateral hole boring apparatus 2 to bore a lateral hole L for laying a new pipe P.

In boring the lateral hole L, the flexible shaft 129 for transmitting power may be extended through the outer member 48 and inner member 56, and a handle 180 may be mounted to its upper end as shown in FIG. 10G while its lower end releasably engages the shaft 127 of the gear 125 meshing with the gear 123 mounted to the output shaft of the hydraulic motor 102 for rotating the augers shown in FIG. 7. By this arrangement, the augers 6A and 6B can be both automatically rotated and manually actuated to bore the lateral hole L. When boring is manually performed, it is possible to detect the presence of any obstacle to the progress of the augers 6A and 6B by the feel of the handle grasped by the operator.

When it is desired to withdraw the augers 6A and 6B after the operation of boring the lateral hole L is finished, the new pipe P formed of a synthetic resinous and flexible material to be laid in the lateral hole L is inserted from a pit H formed in the premises of a household to which town gas is to be supplied and coupled to a forward end of the leading auger 6A. Then, the augers 6A and 6B are moved rearwardly from the lateral hole L to allow the new pipe P to be laid in the lateral hole L. After the new pipe P is thus laid in the lateral hole L, it is connected to the existing underground main Q. The connection is effected by using a tool that can be manipulated by the operator positioned on the ground level.

Figure 10H:
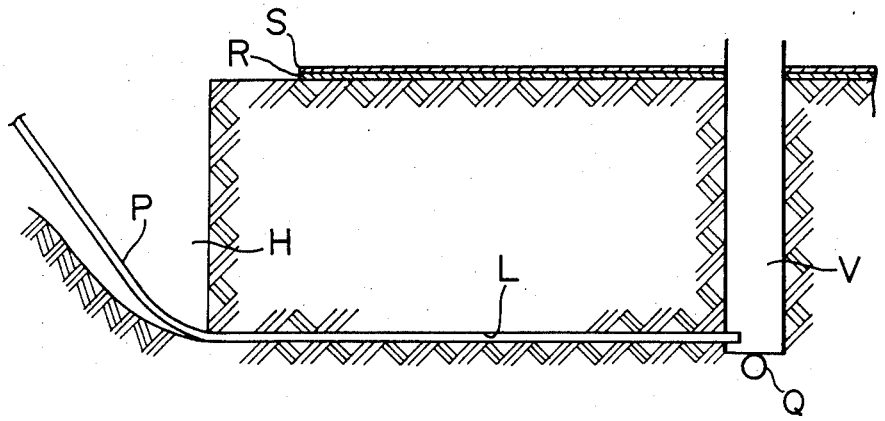
Figure 10I:
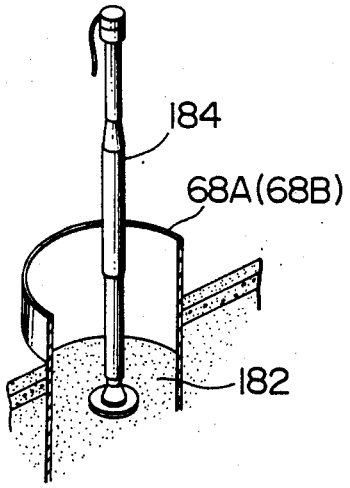
Figure 10J:
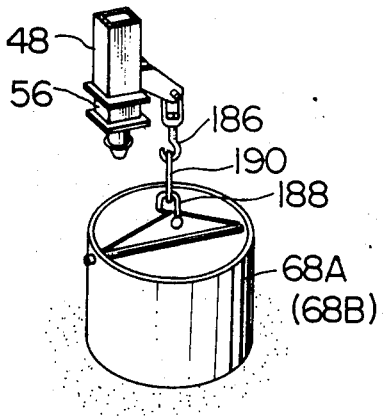

After the new pipe P is laid and connected to the existing underground main Q, soil 182 is thrown into the casings 68A and 68B in volumes large enough to partially fill the casings 68A and 68B and compacted by using a suitable tool, such as a manually-operated member 184. Then, the casing 68A or 68B is lifted as shown in FIG. 10J, by using a hanger 186 having a hook attached to the outer member 48, a rod 188 connected to the casing 68A or 68B and a rope 190. Thereafter, the soil 182 in the casings 68A and 68B is again compacted. These operations are repeatedly performed until the pipe of soil 182 in the casings 68A and 68B comes up to the bottom of the macadam layer, and the casing 68A or 68B is completely removed from the ground. The road is then backfilled with macadam and paved with asphalt.

Figure 10K:
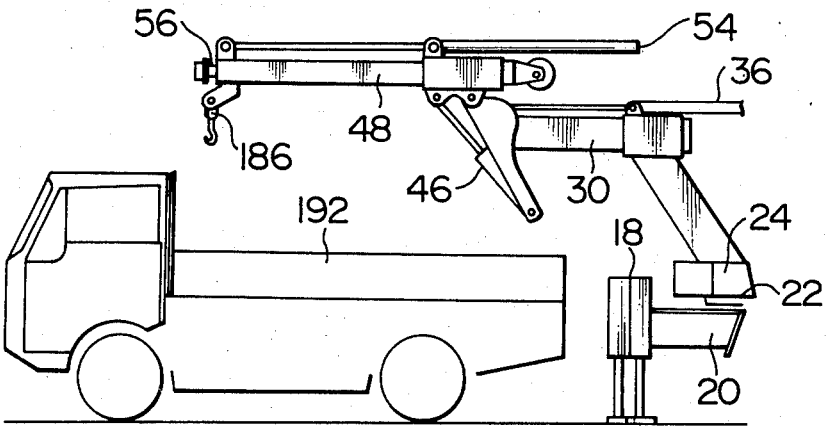

After finishing the road restoration, as shown in FIG. 10K, the outer member 48 is brought to a substantially horizontal position and the swing 24 and hydraulic cylinders 36 and 54 are actuated to load by utilizing the angle means 186, a truck 192 with the earth removed from under the ground and tools used to perform the hole-boring and pipe-laying operations.

By boring the lateral hole L as described hereinabove, it is possible to reduce the cross-sectional area of the vertical hole V used to have access to the existing main Q from the surface of the ground, as compared with the cross-sectional area of a conventional vertical hole. Additionally, the casings 68A and 68B are force-fitted into the ground to form the vertical hole V without disintegration of the vertical hole V, and the need to dig a ditch across the road is eliminated, thereby making it possible to perform a full-scale repair upon completion of the operation of laying the new pipe P while maintaining the road in good condition. This is conducive to a marked reduction in the period of time required for laying the new pipe P by boring the lateral hole L, because the operation can be finished in one day. The earth removed by the excavation work is greatly reduced in volume, and the elimination of the need to perform temporary repair greatly reduces the workforce required for the operation. Thus, the share of expenses for laying the new pipe P in total expenses for performing the civil engineering operations can be reduced from about 80% to about 50%, and the expenses for laying the new pipe P can be reduced by about 60%.

The second embodiment of the invention has been described in conjunction with the operation of laying a new pipe to be connected to an existing main to supply town gas to a property, as shown in FIGS. 10A–10K and 11–15. However, it is to be understood that this embodiment can be carried into practice not only in boring a lateral hole for laying a new pipe to be connected to an existing main for supplying city gas, but also in boring a lateral hole for laying a new pipe to be connected to an existing water or other fluid supply line or for laying a new tube to be connected to an existing tube for housing electrical cables or communication lines.

FIGS. 16–21 illustrate another embodiment of the apparatus for boring a lateral hole suitable for carrying the method of boring a lateral hole according to the invention into practice.

Figure 19:
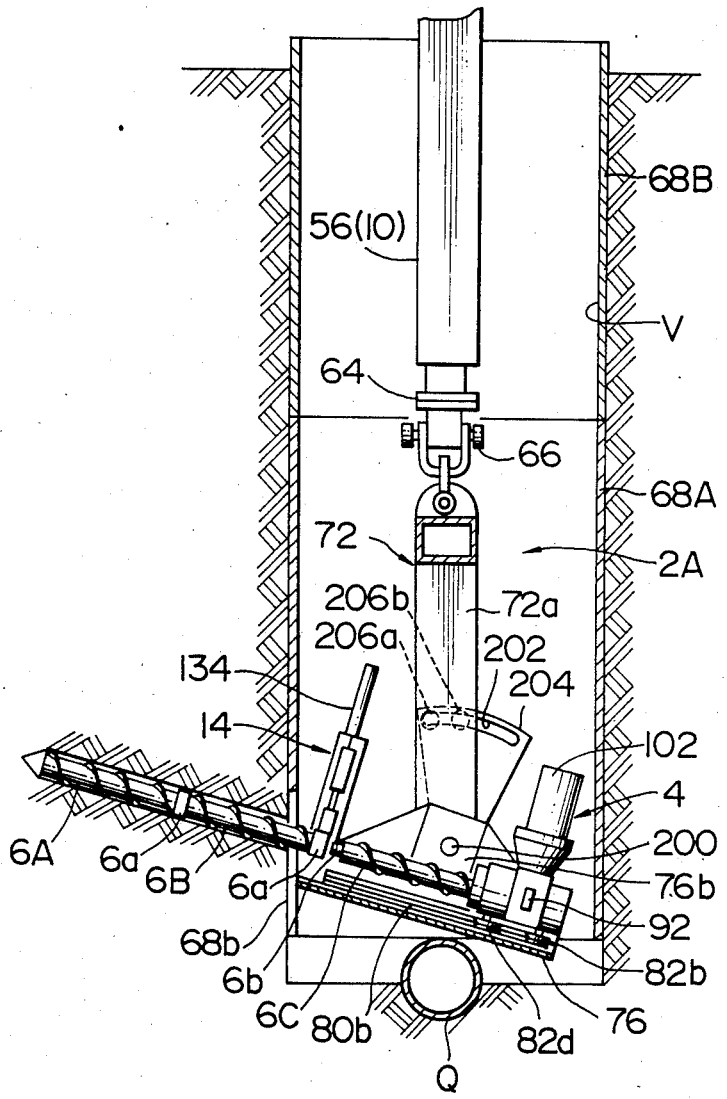
FIG. 19 is a sectional view of the second embodiment of the apparatus for boring a lateral hole according to the invention, showing the apparatus as being used in ta tilting position.
Figure 20:
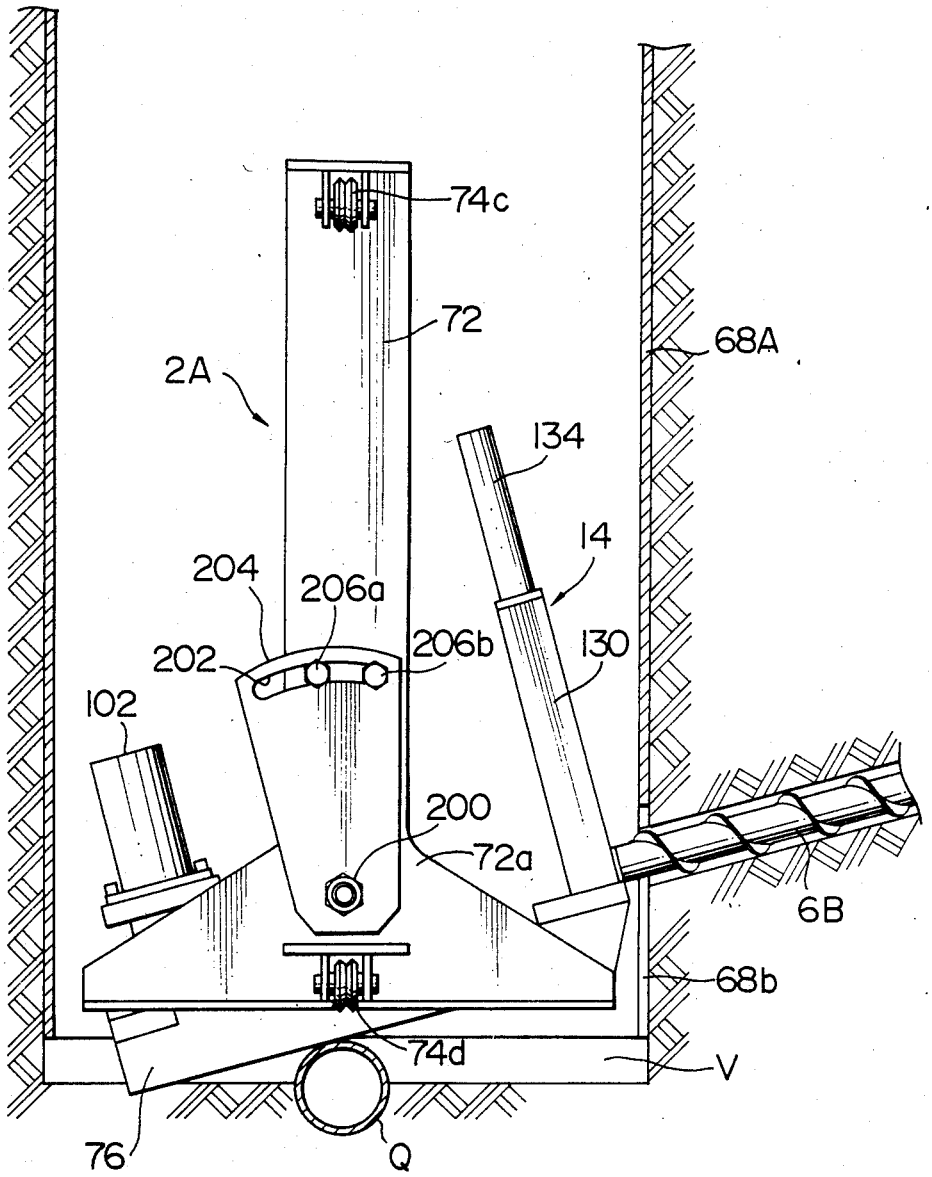
FIG. 20 is a side view, on an enlarged scale, of the apparatus shown in FIG. 19.
Figure 21:
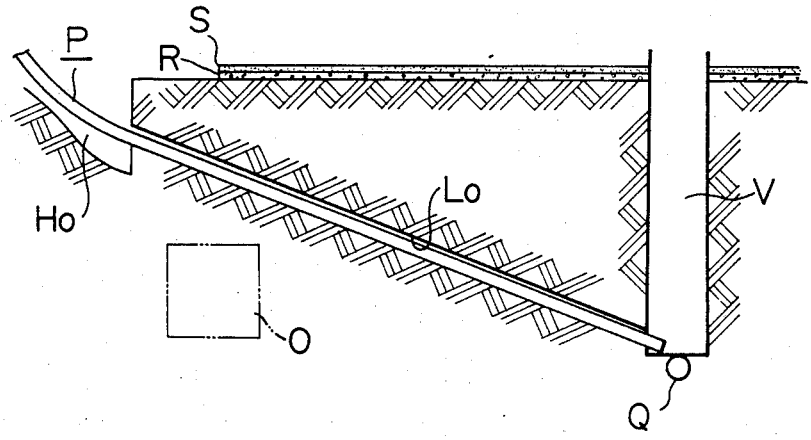
FIG. 21 is a sectional view of tilting lateral hole formed by a boring operation performed by the second embodiment of the apparatus for boring a lateral hole according to the invention.

The lateral hole boring apparatus shown in FIGS. 16–21 is generally designated by the reference numeral 2A and is distinct from the lateral hole boring apparatus 2 described by referring to FIGS. 4–9 by the manner in which the guide frame 76 is connected to the support frame 72. The guide frame 76 has attached to one side a connecting member **76*b* to which a connecting pin 200 is secured at one end. The connecting pin 200 rotatably extends through one vertical member 72*a* of the support frame 72 and has secured to an opposite end thereof an adjusting plate 204 formed with an arcuate slot 202 as shown in FIG. 20. Fixing bolt 206*a* and 206*b* extend through the arcuate slot 202 and threadably engage threaded openings formed in a receiver plate (not shown) secured to the vertical member 72*a*. By this arrangement, the guide frame 76 can be moved in pivotal movement about the pin 200 by loosening the fixing bolts 206*a* and 206*b*, and the guide frame 76 can be fixed to the support frame 72 by tightening the fixing bolts 206*a* and 206*b*. The tilting angle of the guide frame 76 is preferably in the range between the angle at which the guide frame 76 or the augers 6A, 6B and 6C are horizontally disposed and the angles of about 15–20 degrees at which the leading end of the auger 6A** is disposed with respect to the horizontal.

As described hereinabove, the guide frame 76 can be titled with respect to the support frame 72 in the lateral hole boring apparatus 2A. By tilting the guide frame 76, as shown in FIGS. 19 and 20, it is possible to bore a tilting lateral hole Lo which is inclined with respect to the horizontal in such a manner than an end of the lateral hole Lo (FIG. 21) disposed in the premises of a property to which water or gas is intended to be supplied is located at a higher level than an opposite end. Thus, it is possible to make the diameter and depth of a pit Ho formed at the end of the lateral hole Lo disposed in the premises of the property smaller than those of a pit H formed when the horizontal lateral hole L is formed by the lateral hole boring apparatus 2 as shown in FIG. 10H, thereby reducing the volume of earth removed. Also, in the event that there is some obstacle O, it is possible to bore a lateral hole Lo which bypasses the obstacle O.

In the system of FIGS. 22–25, the lateral hole boring apparatus generally designated by the reference numeral 302 comprises an elevatory frame 308 including a gate-type support frame 304 and a guide frame 306 secured to the support frame 304. The support frame 304 includes left and right posts **304*a* and 304*b* having guide rollers 310***a*, 310*b*, 310*c* and 310*d* secured to upper and lower portions thereof for rolling movement along the guide rails 70*a* and 70*b* secured to the inner wall surface of the casings 68A and 68B in diametrically opposed positions and extending vertically. The guide frame 306, secured to the support frame 304, supports the auger drive unit 4 for movement therealong, as is the case with the guide frame 76 described in connection with FIGS. 4–6.

Figure 25:
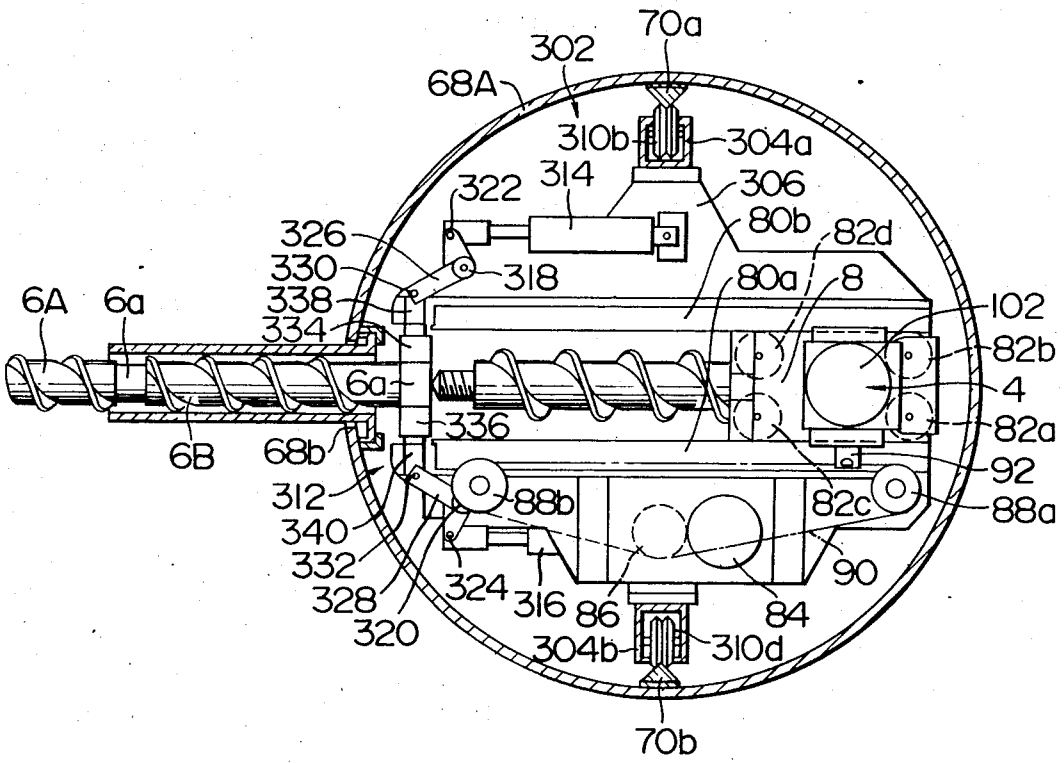
FIG. 25 is a sectional view taken along the line XXV—XXV in FIG. 22.

Secured to one end portion of the guide frame 306 is fixing chuck means 312 for detaching augers which comprises, as shown in FIG. 25, a pair of hydraulic cylinders 314 and 316 located on the left and right sides and secured to the guide frame 306 through pins, a pair of links 326 and 328 connected to the guide frame 306 for pivotal movement about pins 318 and 320 and connected at one end thereof to piston rods of the hydraulic cylinders 314 and 316 through pins 322 and 324, respectively, and claw holders 338 and 340 secured to an opposite end of the links 326 and 328 through pins 330 and 332, respectively, and having at a forward end claws 334 and 336 for gripping the connection 6*a* of the auger 6. As the hydraulic cylinders 314 and 316 are extended and contracted, the connection 6*a* can be gripped and released by the claws 334 and 336.

Figure 22:
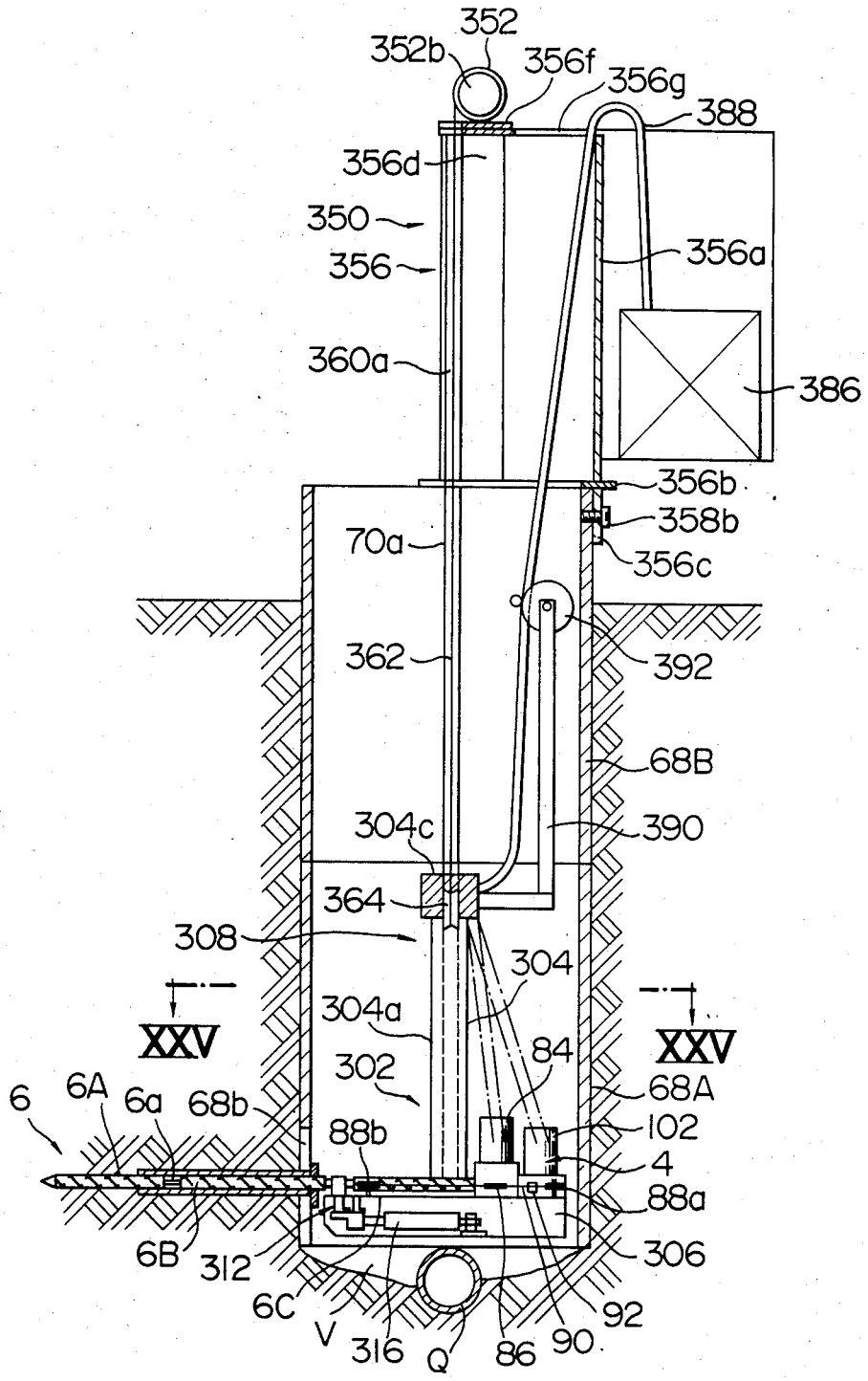
FIG. 22 is a sectional side view of one example of the lateral hole boring system comprising a lateral hole boring apparatus and lifting means suitable for carrying the lateral hole boring method according to the invention into practice.

In place of the apparatus 16 used in the embodiments described hereinabove, lifting and lowering means 350 are employed for moving the lateral hole boring apparatus 302 upwardly and downwardly. The lifting and lowering means 350 comprises, as shown in FIG. 22, a frame structure 356 supporting a winch 352 and a control panel 354, with the frame structure 356 including a main frame body 356*a*, of substantially semi-cylindrical configuration, having a semi-circular flange portion 356*b* at its lower end. The frame structure 356 is secured to the casing 68B by placing the flange portion 356*b* on top of the casing 68B and fixing a lower end portion 356*c* by fasteners such as, for example, screws 358*a*, 358*b* and 358*c* to the side of an upper portion of the casing 68B. The frame structure 356 also includes vertical frames 356*d* and 356*e* attached to an inner surface of the main frame body 356*a* on left and right sides and supporting guide rails 360*a* and 360*b* which are adapted to be connected to the guide rails 70*a* and 70*b* of the casing 68B. A support member 356*f*, supporting the winch 352, is interposed between upper ends of the vertical members 356*d* and 356*e*. The winch 352 comprises a hydraulic motor 352*a* and two drums 352*b* and 352*c*. A wire rope 362 which is wound on the drums 352*b* and 352*c* and payed out therefrom is trained over a sieve 364 (FIG. 22) attached to a central portion of an upper member 304*c* of the support frame 304. As the hydraulic motor 352*a* is rotated in the normal and reverse directions, the lateral hole boring apparatus 302 can be moved upwardly and downwardly.

Figure 24:
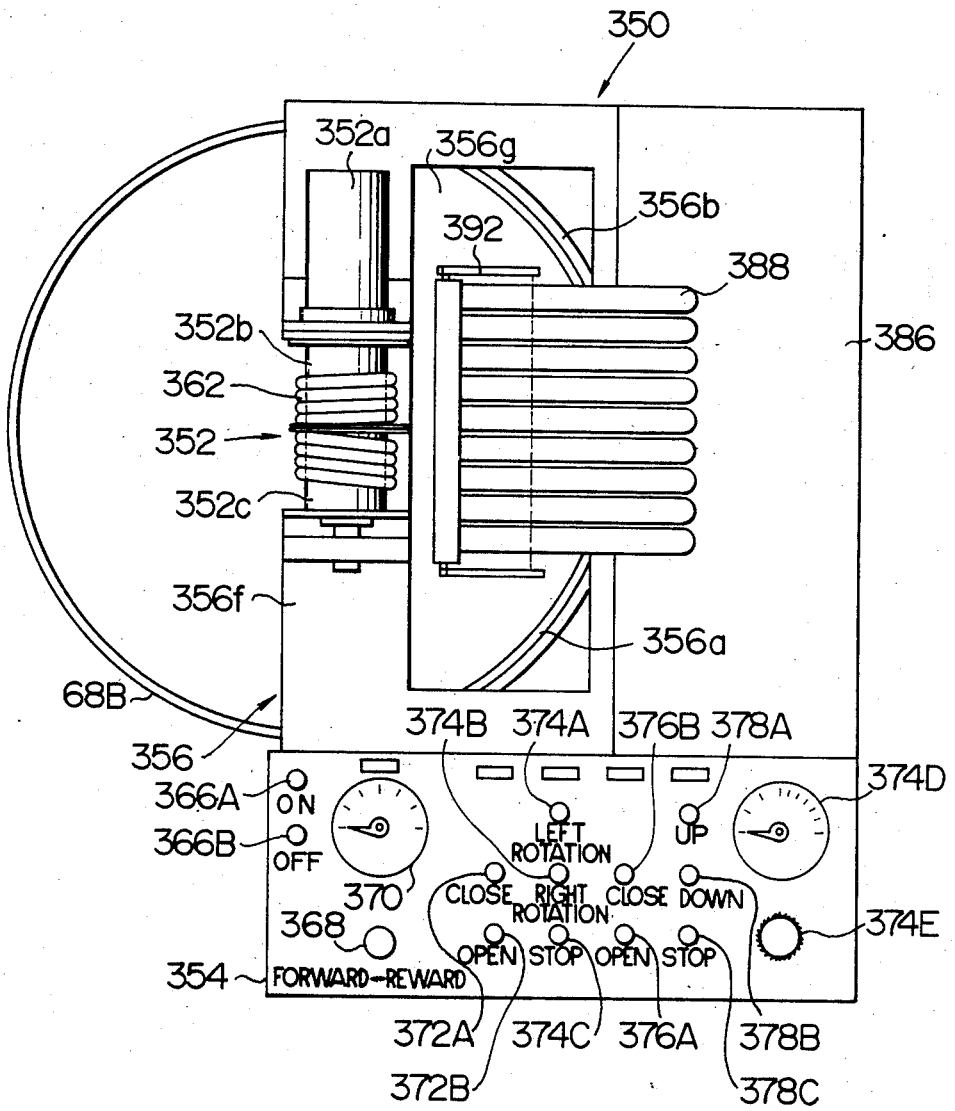
FIG. 24 is a top plan view o the system shown in FIG. 22.

Referring to FIG. 24, the control panel 354 mounts thereon switches 366A and 366B for turning on and off a power source, an operation lever 368 for controlling the flow rate and direction of flow of a hydraulic fluid or working fluid to the travel hydraulic motor 84, an oil pressure gauge 370 for indicating the pressure of the working fluid flowing to the travel hydraulic motor 84, push-button switches 372A and 372B for actuating the hydraulic cylinders 314 and 316 of the stationary chuck means 312 to move the claws 334 and 336 between an open position and a closed position, push-button switches 374A, 374B and 374C for giving instructions to the travel hydraulic motor 84 to rotate the auger 6 counterclockwise and clockwise and stop its rotation, respectively, an oil pressure gauge 374D for indicating the pressure of the working fluid flowing to the hydraulic motor 102, a variable knob 374E for regulating the flow rate of the working fluid to the travel hydraulic motor 84, push-button switches 376A and 376B for moving the rotary chuck means 8 between an open position and a closed position, and push-button switches 378A, 378B and 378C for giving instructions to the winch 352 to wind and pay out the wire rope 362 and stop its movement, respectively.

Figure 23:
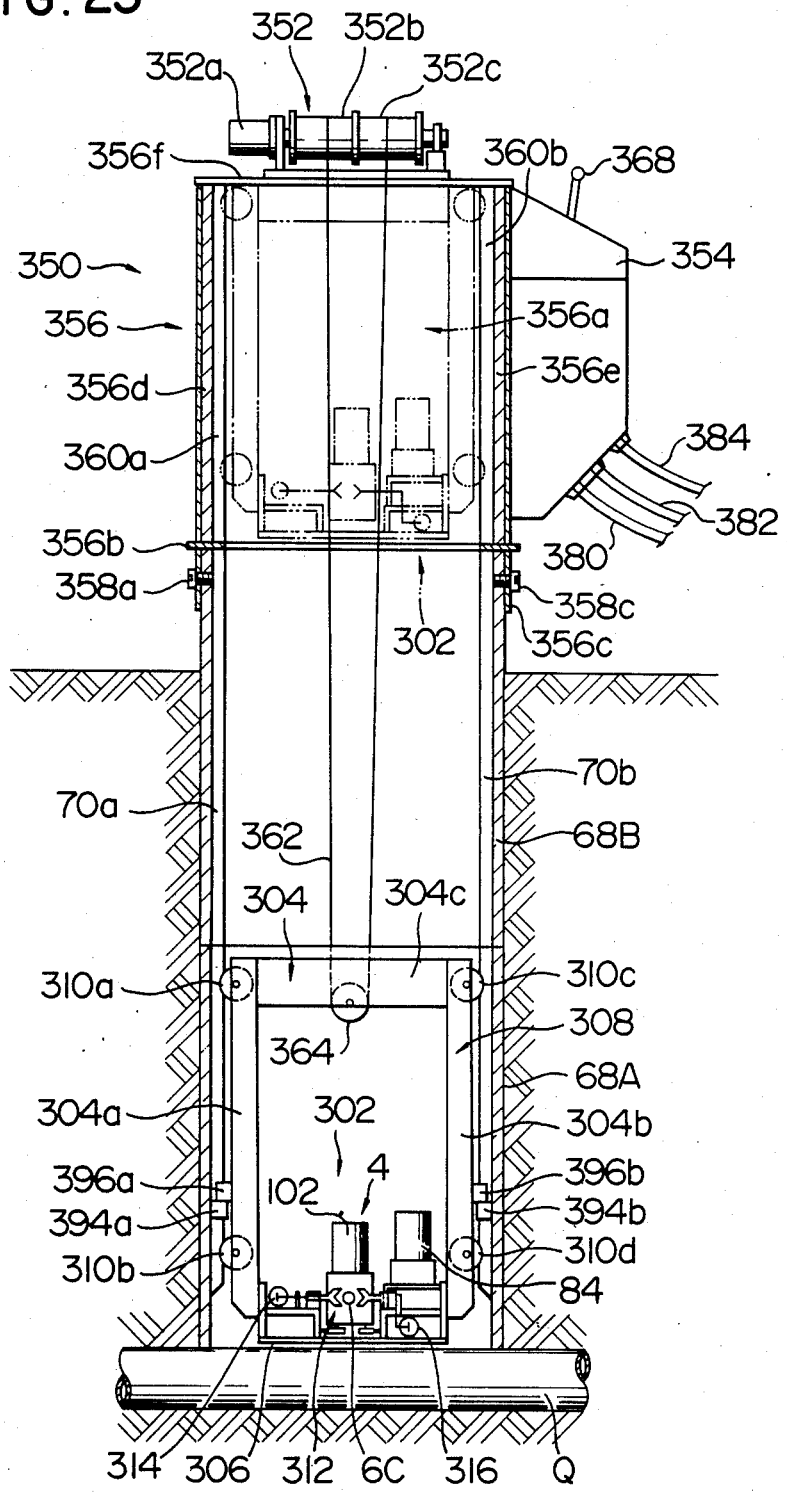
FIG. 23 is a front sectional view of the system shown in FIG. 22.

Referring to FIG. 23, hydraulic fluid hoses 380 and 382 and a cable 384 are connected at one end thereof to a hydraulic pump, a hydraulic fluid tank and a power source (not shown) mounted on a working vehicle (not shown), respectively, and at the other end thereof to the control panel 354. The hydraulic fluid hoses 380 and 382 provide branch channels for hydraulic fluid handling devices, such as valves in the control panel 354, operated by the push-button switches, and for hydraulic fluid handling devices 386 (including valves not mounted in the control panel 354) mounted on a rear end of the frame 356 as shown in FIG. 22. A hydraulic fluid hose group 388 comprising a plurality of pairs of hydraulic fluid hoses, each pair constituting one of the branch channel, is connected to drive means of the above described various devices, such as the hydraulic cylinders 314 and 316 of the fixing chuck means 312, the drive of the rotary chuck means 8 and the hydraulic motors 84 and 102.

Referring to FIG. 22, an L-shaped member 390 is attached to the upper member 304*c* of the support frame 304, and a roller 392, for supporting the hydraulic fluid hose group 388, is located on top of the L-shaped member 390 to prevent the hydraulic fluid hose group 388 from loosening. By this arrangement, a portion of the hydraulic fluid hose group 388, located between the upper member 304*c* of the frame 304 and the main frame body 356*a*, becomes substantially taut when the lateral hole boring apparatus 302 is disposed in the lowermost position as shown in FIG. 22. The hydraulic fluid hose group 388 becomes slightly loose when the apparatus 302 moves upwardly, but this does not interfere with the upward movement of the apparatus 302. As the upper end of the support frame 304 reaches the upper end of the casing 68B, the roller 392 extends through an opening 356*g* in the upper portion of the main frame body 356*a* above the frame structure 356 to push the hydraulic fluid hose group 388 upwardly to tighten same.

The frame structure 356 is open at the front and its height from the upper end of the casing 68B is such that, when the apparatus 302 is moved to the uppermost position indicated by imaginary lines in FIG. 23, the rotary chuck means 8 is located above the casing 68B. By this arrangement, attaching and detaching the auger 6 can be readily effected.

When the lateral hole boring apparatus 302 is used to bore a lateral hole, the apparatus 302 is moved to the uppermost position indicated in phantom lines in FIG. 23 and the auger drive unit 4 is moved to its rearward position. After the leading auger 6A is attached to the rotary chuck means 8, the winch 352 is actuated to pay out the wire rope 362 to move the apparatus 302 downwardly to a solid-line position in which stoppers 394*a* and 394*b*, located at the lower end portions of the guide rails 70*a* and 70*b*, are brought into locking engagement with locking members 396*a* and 396*b* secured to the support frame 304, respectively. Thereafter, the later hole L is formed by the lateral hole boring apparatus 302 in the same manner as described above while moving the apparatus 302 upwardly and downwardly by the lifting and lowering means 350 to attach and detach the augers 6.

The lateral hole boring operation can be performed by operator manipulation of the switches or levers on the control panel 354 while looking into the vertical hole V.

In the above described embodiment, the control panel 354 and hydraulic fluid handling devices 386 are located at the frame 356 on the casing 68B. However, this is not restrictive and they may be located in the vicinity of the casing 68B. The hydraulic and electric power sources may be formed into a unitary structure with the control panel 354 or constitute entities separate therefrom and located on the ground level, with the drive means being electrically operated.

Figure 26:
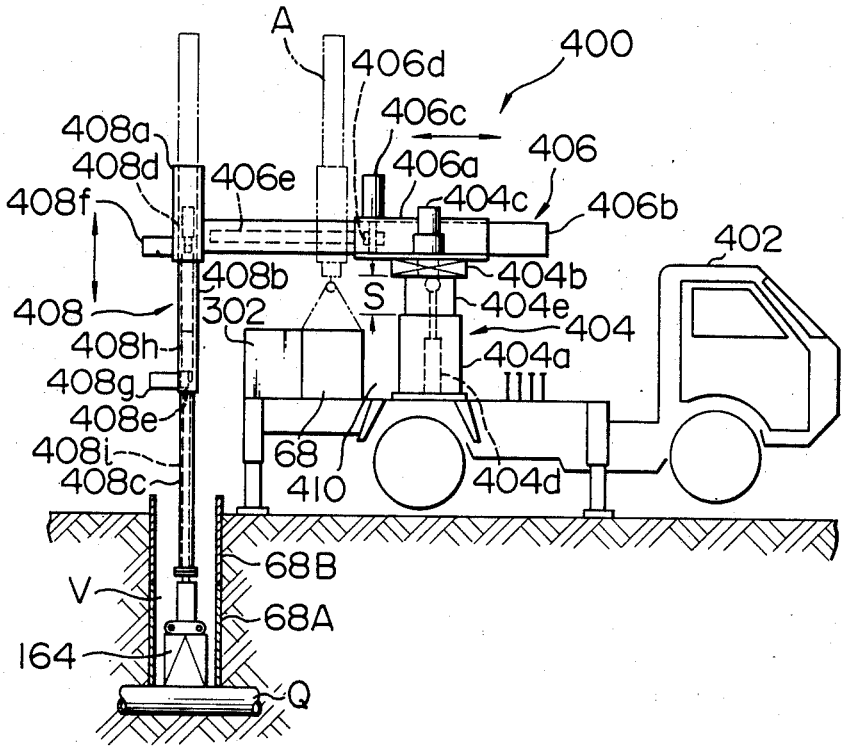
FIG. 26 is a side view of an apparatus particularly suitable for forming a vertical hole when a lateral hole is formed by the method according to the invention.
Figure 27:
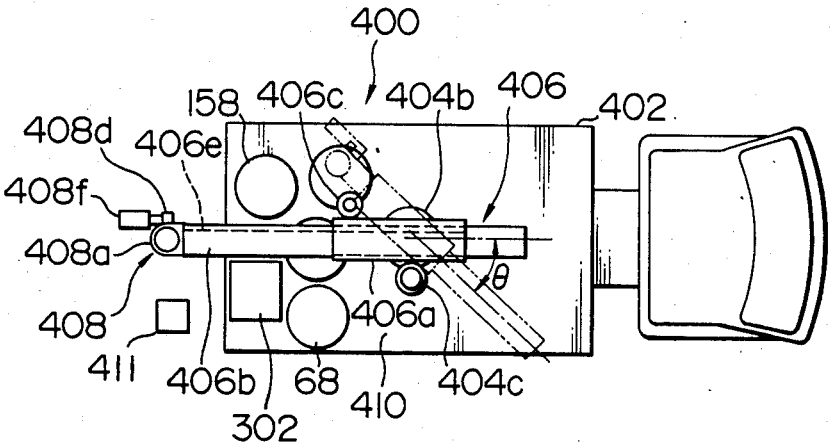
FIG. 27 is a top plan view of the apparatus shown in FIG. 26.

As shown in FIGS. 26 and 27, the working machine 400 comprises a swing support 404 located on a truck 402 and comprising a cylindrical support **404*a*, an annular swing member 404*b* located on the cylindrical support 404*a* and a hydraulic motor 404*c* for moving a swinging side of the annular swing member 404*b* in swinging movement. Supported on the swinging side of the annular swing member 404*b* is a horizontal telescopic arm 406 including an outer arm 406*a* of substantially cylindrical configuration secured to the swinging side of the annular swinging member 404*b*, and an inner arm 406*b* of large length slidably fitted in the outer arm 406*a*. A pinion 406*d*, rotated by a hydraulic motor 406*c* supported by the outer arm 406*a*, is maintained in meshing engagement with a rack 406*e* supported by the inner arm 406*b*. Actuation of the hydraulic motor 406*g* causes the inner arm 406*b* to move inside the outer arm 406*a*. The horizontal telescopic arm 406 can be moved rearwardly and through an angle $\theta$ in swinging movement as shown in FIG. 27 by the annular swing member 404*b***.

Connected to a forward end of the inner arm **406*b* is a vertical telescopic arm 408 including an outer arm 408*a* of substantially cylindrical configuration secured to the inner arm 406*b* and extending vertically, an intermediate arm 408*b* of substantially cylindrical configuration slidably fitted in the outer arm 408*a* and an inner arm 408*c* of substantially cylindrical configuration slidably fitted in the intermediate arm 408*b*. Hydraulic motors 408*f* and 408*g*, having pinions 408*d* and 408*e*, are connected to lower end portions of the outer arm 408*a* and intermediate arm 408*b*, respectively, and racks 408*h* and 408*i*, meshing with the pinions 408*d* and 408*e*, are secured to the intermediate arm 408*b* and inner arm 408*c*, respectively. Actuation of the hydraulic motors 408*f* and 408*g* causes the intermediate arm 408*b* and inner arm 408*c* to vertically move. The bucket 164 or the cutter 158 of the rotary-type boring machine for boring a hole in an asphalt layer of a road is respectively mounted at a lower end of the inner arm 408*c***.

The truck 402 has a space 410 rearwadly of the swing support 404 for mounting the casing 68, lateral hole boring apparatus 302, bucket 164, rotary boring machine 158 for boring a hole in the asphalt layer of the road, and other boring machine.

When it is desired to attach, replace or move a boring machine, the horizontal telescopic arm 406 and vertical telescopic arm 408 are contracted as indicated at A in FIG. 26 and the swing motor **404*c* is actuated to pivotally move the horizontal telescopic arm 406 to bring the vertical telescopic arm 408 to a position above the desired boring machine. Then the boring machine is attached to the vertical telescopic arm 408 or suspended therefrom by a hook and moved to a position in which a vertical hole V is to be formed. In this case, the maximum swinging angle $\theta$ of the annular swinging member 404 in its leftward and rightward movement is small as indicated in FIG. 27**.

A control panel for operating the hydraulic motor **404*c* for driving the annular swing member 404*b*, the hydraulic motors 406*c*, 408*f* and 408*g* for driving the horizontal and vertical telescopic arms 406 and 408, the bucket 164, the cutter 158 of the boring machine for boring a hole in the asphalt layer, and the actuator of the lateral hole boring apparatus 302 may be located, as indicated at 411 in FIG. 27, in the vicinity of the vertical hole V to be formed, or fixed to the casing 68B as is the case with the embodiment shown in FIGS. 2–25** after the vertical hole V has been formed, so that the operation can be performed by a single operator while looking into the vertical hole V.

The swing support 404 may be formed as a telescopic structure and may be removably mounted on an ordinary truck. More specifically, the cylindrical support **404*a* secured to the truck 402 serves as an outer member, and an inner member 404*e* that can be moved in elevatory movement in a stroke S by a hydraulic cylinder 404*d* is fitted in the cylindrical support 404*a* for telescopic movement. The horizontal telescopic arm 406 is mounted on the inner member 404*e* through the annular swing member 404*b***.

By this arrangement, the horizontal telescopic arm 406 can be moved to a higher level by actuating the hydraulic cylinder **404*d* during operation to thereby enable the boring machine attaching and detaching operations to be performed at a higher level and facilitate the operations. When the truck 402 is running, the hydraulic cylinder 404*d* is actuated to move the horizontal telescopic arm 406 to a lower level to thereby reduce the overall height of the truck 402**.

From the foregoing description, it will be appreciated that the method of and apparatus for boring a lateral hole according to the invention can achieve a number of advantageous effects. More particularly, a preformed vertical hole having a predetermined depth in preparation for boring a lateral hole can be reduced in cross-sectional area as compared with vertical holes formed previously in boring vertical holes by the prior art. The vertical hole necessary for carrying the lateral hole boring method into practice only has to be large enough to move the lateral hole boring apparatus upwardly and downwardly therein. This greatly reduces the volume of earth removed and makes it possible to shorten the period of time and cut the expenses and workforce necessary for boring a lateral hole. The use of a vertical hole of a small cross-sectional area makes it possible to minimize road traffic obstruction. The invention eliminates the need for the operator to enter the vertical hole, enabling a lateral hole boring operation to be performed without any danger.

According to the invention, the augers used for boring a lateral hole can be detached one from another and withdrawn from the hole to be lifted to the ground by the operator who operates the apparatus on the ground level. This eliminates the need to use an additional device for withdrawing a series of augers of large total length and makes it possible to insert a pipe into the lateral hole simultaneously as the augers are withdrawn from the lateral hole.

The invention eliminates the need to dig a ditch which has been dug for laying a pipe by an open-cut process in the prior art. Thus, when the method according to the invention is compared with the open-cut process of the prior art, the invention offers the additional advantage that, besides being able to reduce the cross-sectional area of the vertical hole, the elimination of the need to dig a ditch further reduces expenses and workforce and reduces the period of time necessary for performing a lateral hole boring operation while minimizing road traffic obstruction.

According to the invention, casings may be forced into the vertical hole in performing an operation. This is conducive to prevention of the disintegration of the vertical hole and enables positioning of the lateral hole boring apparatus to be readily effected.

The guide frame supporting the auger drive unit of the lateral hole boring apparatus can be connected to the support frame in such a manner that the tilting angle of the guide frame can be adjusted as desired with respect to the support frame. This makes it possible to bore a lateral hole disposed at a desired angle with respect to the horizontal. This feature makes it possible to reduce the dimensions of a hole formed at the end of the lateral hole located in the premises of a property to which gas or water is intended to be supplied and to bypass any obstacle that might lay ahead of the lateral hole to be formed by the method according to the invention.

When it is desired to couple an additional auger to the auger in use, it is possible to let the additional auger be gripped by the rotary chuck means on the ground level and moved downwardly to the bottom of the vertical hole where it can be coupled to the auger in use to serve as a trailing auger, thereby enabling the auger to be readily coupled or uncoupled to the auger drive unit on the ground level. If it is necessary to perform the auger coupling or uncoupling operation at the bottom of the vertical hole, the size of the vertical hole could not be much reduced because the space for lifting the augers would be required in addition to the space for accommodating hydraulic fluid hoses (cables when electrical equipment is used) connected to the hydraulic machines used for actuating the lateral hole boring apparatus and elevatory means for the auger. According to the invention, the need to provide space for moving the auger upwardly and downwardly in the vertical hole is eliminated because the auger is coupled or uncoupled to the auger drive unit on the ground level, thereby enabling the size of the vertical hole to be reduced and the volume of the earth removed to be minimized. In coupling the trailing auger to the leading auger, the connection of the leading auger is gripped by the fixing chuck means and the connection of the trailing auger is brought into threadable engagement with the connection of the leading auger. This enables the trailing auger to be smoothly coupled to the leading auger because centering can be positively effected.

What is claimed is:

1. A method of boring a lateral hole underground the method comprising the steps of:

(a) preparing a vertical hole of a desired depth extending from a surface of the ground into the earth;

(b) preparing a lateral hole boring apparatus, a leading sugar of a length smaller than a diameter of the vertical hole, and a plurality of coupling augers each of a length smaller than the diameter of the vertical hole;

(c) attaching the leading auger to the lateral hole boring apparatus outside said vertical hole;

(d) lowering the lateral hole boring apparatus equipped with the leading auger into the vertical hole and stopping the apparatus in a desired position in the vertical hole;

(e) manipulating said lateral hole boring apparatus from the ground level to drive and advance said leading auger to bore a lateral hole;

(f) stopping the driving and advancing of the leading auger when the lateral hole has reached a predetermined length commensurate with the length of the leading auger;

(g) manipulating the lateral hole boring aparatus from the ground level to detach the leading auger from lateral hole boring apparatus;

(h) lifting the lateral hole boring apparatus above the vertical hole while leaving the leading auger in the lateral hole;

(i) attaching one of the coupling augers to the lateral hole boring apparatus outside the vertical hole;

(j) lowering the lateral hole boring apparatus equipped with the coupling auger into the vertical hole again until it reaches the predetermined position;

(k) manipulating the lateral hole boring apparatus from the ground level to connect to the coupling auger to the leading auger left behind in the lateral hole;

(l) repeating the steps (e) to (k) until the lateral hole has reached a predetermined final length.

(m) manipulating the the lateral hole boring apparatus from the ground level, after the lateral hole of the predetermined final length has been formed, to rearwardly move the leading auger and all coupling augers disposed in the lateral hole a distance corresponding to a length of one coupling auger;

(n) manipulating the lateral hole boring apparatus from the ground level to detach the extremity trailing auger of the rearwardly moved augers from the rest of the augers;

(o) lifting the lateral hole boring apparatus equipped with the extremity trailing auger above the vertical hole while leaving the rest of the augers in the lateral hole;

(p) detaching the extremity trailing auger from the lateral hole boring apparatus outside the vertical hole;

(q) again lowering the lateral hole boring apparatus into the vertical hole until the hole boring apparatus reaches the predetermined position;

(r) manipulating the lateral hole boring apparatus from the ground level to make the lateral hole boring apparatus grasp the next trailing auger remaining in the lateral hole;

(s) and repeating the steps (m)–(r) until all the augers including the leading auger have been withdrawn from the lateral hole and returned to the ground level.

2. A method as claimed in claim 1, further comprising the step of:

(t) coupling a flexible pipe to a front end of the leading auger prior to moving rearwardly the leading auger and all the coupling auger left behind in the lateral hole following the formation of the lateral hole of the predetermined final length, whereby the pipe can be inserted into the lateral hole simultaneously as the augers are withdrawn from the lateral hole.

3. A method as claimed in claim 1, wherein the step (a) of preparing a vertical hole of a desired depth extending from the surface of the ground down into the earth comprises the step of forcing at least one cylindrical casing into the earth from the surface of the ground while excavating to form the vertical hole defined by said casing, said leading auger and coupling augers each having a length smaller than the inner diameter of said casing.

4. An apparatus for boring an underground lateral hole, the apparatus comprising:

frame means including a support frame, and a guide frame connected to a lower end of said support frame;

auger drive means for rotating augers mounted to the guide frame for travelling therealong;

powered travel means supported by the frame means for travelling the auger drive means forwardly and rearwardly along the guide frame;

powered rotary chuck means mounted to the auger drive means for releasably gripping a rear end of a first auger to transmit rotation of the auger drive means thereto;

powered stationary chuck means mounted on said guide frame for releasably gripping the rear end of a second auger remaining in the bored lateral hole to prevent rotation of said first auger from transmitting to said second auger when said first auger is gripped by said rotary chuck means and is caused to rotate by said auger drive means, at least said rear end of said second auger being located outside of the bored lateral hole;

lifting and lower means disposed on the ground level and connected to said support frame for lifting said frame means from a vertical hole to the ground level and lowering said frame means from the ground level to the vertical hole through said support frame together with said auger drive means, powered travel means, powered rotary chuck means and powered stationary chuck means; and operating means disposed on the ground level and associated with said auger drive means, powered travel means, powered rotary chuck means and powered stationary chuck means for enabling manipulation of all of said means from the ground level.

5. An apparatus as claimed in claim 4, further comprising:

at least one cylindrical casing for providing a vertical hole defined by an inner wall surface thereof, said casing having first guide means located on the inner wall surface thereof; and second guide means located on said support frame and cooperating with said first guide means to guide vertically said support frame in said casing during lowering and lifting thereof.

6. An apparatus as claimed in claim 5, wherein said first guide means includes a pair of guide rails extending vertically along the length of the casing on the inner wall surface thereof in positions diametrically opposed to each other, and said second guide means includes a plurality of guide rollers rotatably mounted to said support frame for rolling movement along said pair of guide rails.

7. An apparatus as claimed in claim 4, wherein said guide frame is adjustably connected to said support frame in such a manner that the angle of tilting of the guide frame with respect to the support frame can be changed to thereby vary the angle of tilting of a path of travel for the auger drive means as desired with respect to the support frame.

8. An apparatus as claimed in claim 4, wherein said first auger includes a first screw type connection formed at a forward end thereof and said second auger includes a second screw type connection formed at a rear end thereof and adapted to be threadably engaged with the first screw type connection, said operating means as operative to cause said rotary chuck means to grip a rear end of the first auger and said stationary chuck means to grip the rear end of the second auger, and cause said travel means to move forwardly and rearwardly simultaneously with said auger drive means to rotate in a boring direction and counter boring direction as the travel means is caused to move forwardly and rearwardly, respectively, thereby allowing the first screw type connection at the forward end of the first auger to be brought into and out of threadable engagement with the first screw type connection at a rear end of the second auger by manipulation from the ground level.

9. An apparatus as claimed in claim 8, wherein said first screw type connection is of a female screw type and said second screw type connection is of a male screw type.

10. An apparatus as claimed in claim 4, wherein said lifting and lowering means comprises winch means located adjacent to an upper end of said vertical hole.

11. A system as claimed in claim 10, wherein said winch means is supported on a frame structure located on an upper end of a cylindrical casing defining said vertical hole.

12. A system as claimed in claim 11, wherein said frame structure includes a main frame body of substantially semi-cylindrical configuration, and said winch means is supported on an upper end of said main frame body through a support frame.

13. A system as claimed in claim 11, wherein operating means for operating said lateral hole boring apparatus and said lifting and lowering means on the ground level is mounted on at the side of said frame structure.

14. A method is claimed in claim 1, wherein step (a) includes preparing a working apparatus of a vehicle type having a telescopic arm adapted to be elongated in a vertical direction by a hydraulic actuator; attaching an excavating tool to a lower end of said telescopic arm and operating said telescopic arm an excavating tool to bore said vertical hole in the earth; inserting a casing into said vertical bore; detaching said excavating tool from a lower end of said telescopic arm and forcing said casing into the earth by elongating said telescopic arm by utilizing the lower end thereof.

15. A method is claimed in claim 14, wherein said step of forcing the casing into the earth includes forcing the casing down into the earth until a lower end of the casing is caused to abut against an existing main;

and wherein the step (d) includes determining said desired position by the position of said existing main to thereby determine the position of a lateral hole to be formed.

16. A method is claimed in claim 14, further comprising the steps of:

(t) back filling said vertical hole with soil in a predetermined depth and compacting the soil after all the augers have been withdrawn from the lateral hole and restored to the ground level;

(u) withdrawing said casing by a distance corresponding to a depth of the compacted soil by using and shortening said telescopic arm of said working apparatus; and (v) repeatng steps (t)–(v) to completely back fill the vertical hole and fully withdraw the casing out of the earth.

17. An apparatus as claimed in claim 4, wherein said lifting and lowering means comprises a telescopic arm adapted to be elongated in a vertical direction by at least one hydraulic actuator and mounted on a working apparatus of a vehicle disposed on the ground level.

* * * * *